US006177768B1

(12) United States Patent
Kamata et al.

(10) Patent No.: US 6,177,768 B1
(45) Date of Patent: Jan. 23, 2001

(54) DISCHARGE LAMP LIGHTING DEVICE AND ILLUMINATION DEVICE

(75) Inventors: Masahiko Kamata; Tsutomu Kakitani; Keiichi Shimizu, all of Yokohama; Keiji Takahashi, Nagai; Fuminori Nakaya, Miura, all of (JP)

(73) Assignee: Toshiba Lighting & Technology Corp. (JP)

( * ) Notice: Under 35 U.S.C. 154(b), the term of this patent shall be extended for 0 days.

(21) Appl. No.: 09/202,435

(22) PCT Filed: Apr. 17, 1998

(86) PCT No.: PCT/JP98/01761

§ 371 Date: Dec. 15, 1998

§ 102(e) Date: Dec. 15, 1998

(87) PCT Pub. No.: WO98/47323

PCT Pub. Date: Oct. 22, 1998

(30) Foreign Application Priority Data

Apr. 17, 1997 (JP) ..... 9-100018
Apr. 17, 1997 (JP) ..... 9-100019

(51) Int. Cl.[7] ..... H05B 37/00

(52) U.S. Cl. ..... 315/241 R; 315/291; 315/244; 315/DIG. 4

(58) Field of Search ..... 315/225, 209 CD, 315/241 R, 232, 227 R, 307, 224, 209 R, 244, 291, DIG. 4, 207, DIG. 7

(56) References Cited

U.S. PATENT DOCUMENTS 4,053,813 * 10/1977 Kornrumpf et al. ..... 315/206
4,943,886 * 7/1990 Quazi ..... 361/42
5,083,065 * 1/1992 Sakata et al. ..... 315/307
5,309,062 * 5/1994 Perkins et al. ..... 315/53
5,444,310 * 8/1995 Kataoka et al. ..... 307/125
5,493,182 * 2/1996 Sowa et al. ..... 315/291
5,525,870 * 6/1996 Matsuzawa et al. ..... 315/209 R
5,550,433 * 8/1996 Tobler ..... 315/94
5,563,473 * 10/1996 Mattas et al. ..... 315/240
5,585,694 * 12/1996 Goldburt et al. ..... 315/491
5,608,614 * 3/1997 Ohnishi et al. ..... 363/60
5,677,602 * 10/1997 Paul et al. ..... 315/224
5,739,645 * 4/1998 Xia et al. ..... 315/307

FOREIGN PATENT DOCUMENTS 52-121976 * 10/1977 (JP) .
54-25426 * 2/1979 (JP) .
61-218095 * 9/1986 (JP) .
1-231295 * 9/1989 (JP) .
1-294398 * 11/1989 (JP) .
61-273897 * 11/1989 (JP) .
2-65096 * 3/1990 (JP) .
5-135895 * 6/1993 (JP) .
5-506740 * 9/1993 (JP) .
7-130486 * 5/1995 (JP) .
8-102383 * 4/1996 (JP) .
8-273869 * 10/1996 (JP) .

* cited by examiner

*Primary Examiner*—Haissa Philogene
*Assistant Examiner*—Tuyet T. Vo
(74) *Attorney, Agent, or Firm*—Morrison Law Firm

(57) ABSTRACT

The electrodes of a discharge lamp are prevented from reaching damaging temperatures which tend to occur when the discharge lamp is near the end of its useful life. The combination of a discharge lamp and luminaire contribute to ensuring the discharge lamp remains unilluminated when nearing the end of its useful life to prevent high temperature damage. Load circuit characteristics are set to provide low release voltage and high short-circuit current during full-intensity illumination, and high release voltage and low short-circuit current during dimmed operation. The discharge lamp operating in a dimmed mode at the end of its useful life is switched to full-intensity illumination mode to ensure the discharge lamp becomes unilluminated. This configuration prevents high temperatures at the electrodes from damaging the glass bulb, base, socket and other components of the discharge lamp and luminaire.

18 Claims, 15 Drawing Sheets

DISCHARGE LAMP LIGHTING DEVICE AND ILLUMINATION DEVICE

TECHNICAL FIELD

The present invention relates to a discharge lamp lighting device and a luminaire which are capable of coping with a situation where the discharge lamp has come to the last stage of its usable life.

BACKGROUND ART

Generally speaking, a discharge lamp is formed by attaching an electrode and a base, which may be made of plastic, to each end of a glass bulb and fitting the bases to a socket that is mounted on the body of a lighting fixture. When such a discharge lamp is close to the end of its life, it causes a symmetric operating condition, which is an abnormal discharge that heats the regions around the electrodes. This causes a particularly serious problem in case of a discharge lamp having a small diameter glass bulb, which is becoming more commonplace. As the distance between each electrode and the glass bulb of a small diameter-type lamp is minimal, such an abnormal discharge tends to increase the temperature of the glass bulb excessively and often presents the danger of the glass bulb, the plastic bases or the socket melting.

An example of discharge lamp lighting devices of this type is shown in FIG. 26.

The discharge lamp lighting device 1 shown in FIG. 26 includes a commercial AC power source e, a full-wave rectifying circuit 2 having an AC input terminal connected to the commercial AC power source e, a DC/DC converter 3 connected to a DC output terminal of the full-wave rectifying circuit 2, an inverter circuit 4 that serves as a high frequency generating means and is connected to the DC/DC converter 3, and a load circuit 5 connected to the inverter circuit 4.

The load circuit 5 is connected via an inductor L1, which serves as a current limiting element, to a fluorescent lamp FL serving as a discharge lamp. A capacitor C1 is connected in parallel with the fluorescent lamp FL. Also connected in parallel with the fluorescent lamp FL is a life-end detecting circuit 6 that is connected to the inverter circuit 4 and controls the inverter circuit 4, thereby serving as a life-end detecting means. With the configuration as above, fullwave rectification of the AC voltage from the commercial AC power source e is conducted by the full-wave rectifying circuit 2, and the rectified voltage is then converted to DC voltage as it is smoothed and adjusted by the DC/DC converter 3. When this DC voltage is input to the inverter circuit 4, the inverter circuit 4 generates a high frequency voltage at a given frequency, which is applied to the load circuit 5. At the load circuit 5, the high frequency voltage input thereto is applied via the inductor L1 to the fluorescent lamp FL and the capacitor C1. The fluorescent lamp FL and the capacitor C1 generate an appropriate resonance so that a high voltage necessary for the starting up of the fluorescent lamp FL is applied to the fluorescent lamp FL, thereby lighting the fluorescent lamp FL.

Throughout the period when the fluorescent lamp FL is in the 'on' state, the life-end detecting circuit 6 monitors the voltage between the electrodes of the fluorescent lamp FL. When the fluorescent lamp FL1 comes close to the end of its life, the life-end detecting circuit 6 detects the end of the life and controls the inverter circuit 4 to stop its function.

The load characteristics of the load circuit 5 of the discharge lamp lighting device 1 shown in FIG. 26 are shown in FIG. 27, wherein the curve A and the curve B respectively represent the load characteristic curves in the full-intensity illumination mode and in the dimming mode, while the curve c and the curve d respectively represent the operating characteristics of a fluorescent lamp FL functioning in normal conditions and a fluorescent lamp FL close to the end of its life.

The curves representing load characteristics of the load circuit 5 in the full-intensity illumination mode and in the dimming mode have arcs of a similar shape. As the fluorescent lamp FL approaches the end of its life, the lamp voltage gradually increases, and the operating characteristics of the load circuit 5 move upward in the chart of FIG. 27. When the fluorescent lamp FL is operating in normal conditions in the full-intensity illumination mode, the fluorescent lamp FL functions at the point X1, which is the point of intersection between the curve A and the curve c. During the dimming mode, the fluorescent lamp FL functions at the point X2, which is the point of intersection between the curve B and the curve c. In other words, the power output in the dimming mode is lower than in the full-intensity illumination mode.

When the fluorescent lamp FL reaches the end of its life during the full-intensity illumination mode, the fluorescent lamp FL functions at the point Y, which is the point of intersection between the curve A and the curve d, and remains lit in the half-wave discharge condition. This presents the danger of melting of parts or other problems.

As the inverter circuit 4 stops functioning, the fluorescent lamp FL becomes dark. This may also causes security problems.

Conventionally known discharge lamp lighting devices which may overcome the above problems include those that are adapted to light a plurality of fluorescent lamps in such a manner as to extinguish only the lamps that are not working properly while maintaining the normal ones lit. An example of such discharge lamp lighting devices is disclosed in Japanese Patent Laid-Open No. 231295/1989. The discharge lamp lighting device disclosed in said Japanese Patent Laid-Open No. 231295/1989 calls for connecting a plurality of fluorescent lamps in parallel with one another and, upon detecting one or more abnormal lamps when said plurality of fluorescent lamps are lit, reducing the output from the inverter circuit to such a level that the other lamps, i.e. those operating in normal conditions, can remain lit.

In other words, if there is any fluorescent lamp that has reached the end of its life, the discharge lamp lighting device keeps the other fluorescent lamps lit, which are still in normal working conditions, in the state where the output from the high frequency generating means is reduced through the reduction of the output from the inverter circuit. Thus, the minimum necessary illumination level is ensured.

However, should the discharge lamp lighting device disclosed in Japanese Patent Laid-Open No. 231295/1989 be applied to small diameter-tube-type fluorescent lamps, the temperature of the glass bulb of an abnormal lamp would be still too high in spite of the reduced output from the inverter circuit. Furthermore, reducing the output to such a level as to prevent the fluorescent lamp at the end of its life from continuing the discharge makes it difficult to keep the normal fluorescent lamps lit. It is particularly difficult to keep normal fluorescent lamps of a household lighting fixture lit, because a household lighting fixture is normally designed such that a single inverter circuit lights two or more fluorescent lamps which have different rated power consumption.

OBJECT AND SUMMARY OF THE INVENTION

In order to solve the above problems, an object of the present invention is to provide a discharge lamp lighting device and a luminaire that are capable of dimming or turning off a discharge lamp at the end of its life, said discharge lamp lighting device and the luminaire being capable of doing so without the need of a complicated protective circuit even if the discharge lamp is of a small diameter tube type.

The invention includes a load circuit which is provided with a discharge lamp, an inductor and a capacitor, said discharge lamp having hot cathodes; a high frequency generating means for supplying said load circuit with a high frequency output; a control means for controlling said high frequency generating means so as to set said discharge lamp in the full-intensity illumination mode or the dimming mode; and a load characteristic imposing means for giving the load circuit such load characteristics as a relatively low release voltage and a large amount of short-circuit current during full-intensity illumination or preheating of the hot cathodes and as a relatively high release voltage and a small amount of short-circuit current during dimming or at the time of starting up.

With the configuration as above, when heating the hot cathodes, the load characteristic imposing means provides such load characteristics as a relatively low release voltage and a large amount of short-circuit current. As the hot cathodes of the discharge lamp are thus heated to a sufficient extent without the danger of the discharge lamp starting a discharge when the temperature of the hot cathodes is not sufficiently high, the hot cathodes are protected from damage. At the initiation of lighting, such load characteristics as a relatively high release voltage and a small amount of short-circuit current are provided so that application of a high release voltage promotes the starting up of the discharge lamp. During full-intensity illumination, such load characteristics as a low release voltage and a large amount of short-circuit current are provided so as to increase the luminance of the discharge lamp. During dimming, such load characteristics as a high release voltage and a small amount of short-circuit current are provided, thereby enabling the deep dimming of the discharge lamp. In case the discharge lamp reaches the end of its life during full-intensity illumination, the lamp voltage exceeds the release voltage, thereby making it impossible for the discharge lamp to remain lit. As a result, the discharge lamp becomes unilluminated. In cases where a plurality of discharge lamps are connected in parallel with one another, the lamp which has reached the end of its life becomes unilluminated while the other lamps that are in normal conditions remain lit.

According to another feature thereof, the invention includes a plurality of load circuits connected in parallel with one another, each load circuit having hot cathodes, an inductor and a capacitor; a high frequency generating means which is shared by said load circuits and adapted to supply them with a high frequency output; and a load characteristic imposing means for giving the load circuits such load characteristics as to turn off a discharge lamp which has reached the end of its life and keep lamps which are in normal conditions lit at full luminosity.

By setting such load characteristics as to turn off a discharge lamp that belongs to one of the plurality of load circuits connected in parallel with one another whenever said discharge lamp reaches the end of its life while maintaining the normal discharge lamps in the lit state, the invention prevents the hot cathodes of a discharge lamp at the end of its life from being heated, which would be the result of keeping such a discharge lamp in the lit state. At the same time, the invention also prevents such a situation that all the discharge lamps become extinguished, which would cause the entire luminaire to become dark.

According to yet another feature of the invention, the inductor of each load circuit is connected in series with the discharge lamp; the capacitor of each load circuit is connected in parallel with the discharge lamp; and each load circuit is provided with a capacity changing means for changing the capacity of the capacitor.

With the configuration as above, by reducing the capacity of a capacitor, the intrinsic resonance frequency of its load circuit is increased. Therefore, if the output frequency of the high frequency generating means is constant, the release voltage applied to the discharge lamp is reduced. On the contrary, when the capacity of the capacitor is increased, the intrinsic resonance frequency of the load circuit is reduced so that the release voltage applied to the discharge lamp is increased.

According to yet another feature of the invention, the invention includes a detecting means for detecting termination of the life of each discharge lamp so that the capacitance of the capacitor is reduced by the capacity changing means when the termination of the life of a discharge lamp is detected.

By reducing the capacity of the capacitor, the release voltage is reduced at the end of the life of a discharge lamp so that the discharge lamp becomes unilluminated.

According to yet another feature of the invention, the invention includes a frequency changing means for changing the frequency output from the high frequency generating means when the detecting means detects a discharge lamp coming to the end of its life during dimming of said discharge lamp.

With the configuration as above, even in cases where there is the danger of a discharge lamp that has reached the end of its life being lit or maintained in the lit state in the half-wave discharge condition, the invention changes the frequency output from the high frequency generating means upon detection of the termination of the life of the discharge lamp, thereby changing the load characteristics of the corresponding load circuit so that the release voltage is reduced to a level lower than the lamp current of the discharge lamp at the end of the life. Thus, the invention ensures a discharge lamp that has come to the end of its life to be put out without fail.

According to yet another feature of the invention, the discharge lamps of the aforementioned plurality of load circuits have different rated power consumption.

Regardless of whether the discharge lamps have different rated power consumption or the same power consumption, the functions and the benefits of the invention remain the same.

According to yet another feature of the invention, the invention includes a control means which may be changed over between the full-intensity illumination mode and the dimming mode and is adapted to switch the output level of the high frequency generating means to the level for the full-intensity illumination mode when any one of the discharge lamps reaches the end of its life during dimming.

In case a discharge lamp reaches the end of its life during dimming, it tends to remain lit while continuing a symmetric operating condition, because the load characteristics of the load circuit in the dimming mode are so set as to provide a high release voltage. In the full-intensity illumination mode, however, a discharge lamp operates in such load characteristics as a low release voltage and a high short-circuit current. Under such conditions, it is impossible to maintain a discharge lamp at the end of its life in the lit state due to its high lamp voltage. Therefore, by switching the operation mode of the discharge lamp to the full-intensity illumination mode by the use of the control means when the discharge lamp reaches the end of its life, the above configuration ensures that the discharge lamp becomes unilluminated.

According to yet another feature thereof, the invention includes a load circuit having a discharge lamp, an inductor and a capacitor; a high frequency generating means for supplying said load circuit with a high frequency output in such a manner as to generate a high frequency output sufficiently lower than the intrinsic resonance frequency of said load circuit when the discharge lamp is in the full-intensity illumination mode and generate a high frequency output sufficiently higher than the intrinsic resonance frequency of said load circuit when the discharge lamp is in the dimming mode; and a control means for controlling said high frequency generating means so as to set said discharge lamp in the full-intensity illumination mode or the dimming mode.

With the configuration as above, as the frequency generated by the discharge lamp lighting device during full-intensity illumination is sufficiently lower than the intrinsic resonance frequency of said load circuit, the load circuit produces practically no resonance so that the release voltage from the high frequency generating means is low. Although the lamp voltage increases from the normal level when the discharge lamp reaches the end of its life, the discharge lamp becomes unable to remain lit and, therefore, becomes unilluminated, because the release voltage becomes lower than the lamp voltage at the end of the life. As the frequency generated by the discharge lamp lighting device during dimming is higher than the intrinsic resonance frequency of the load circuit, the load circuit generates a resonance, thereby increasing the release voltage from the high frequency generating means and reducing the short-circuit current and, consequently, enabling the deep dimming. In cases where a plurality of discharge lamps are connected in parallel with one another, the lamp which has reached the end of its life becomes unilluminated while the other lamps that are in normal conditions remain lit.

According to yet another feature of the invention, the inductor of the load circuit is connected in series with the discharge lamp; the capacitor has a small capacity and is connected in parallel with the discharge lamp; and the intrinsic resonance frequency of the load circuit is set sufficiently higher than the frequency at which the high frequency generating means operates in the full-intensity illumination mode.

With the configuration as above, wherein the capacitor connected in parallel with the discharge lamp has a small capacity, the discharge lamp lighting device is capable of generating a high frequency which is sufficiently lower than the intrinsic resonance frequency of the load circuit when the discharge lamp is in the full-intensity illumination mode and also generating a high frequency which is sufficiently higher than the intrinsic resonance frequency of the load circuit when the discharge lamp is in the dimming mode.

According to yet another feature of the invention, the operating frequency of the high frequency generating means is set such that:

$f0/3 \leqq f \leqq f0/2$ wherein the operating frequency of the high frequency generating means during full-intensity illumination is represented by f, and the intrinsic resonance frequency of the load circuit is represented by f0.

If the operating frequency f of the high frequency generating means for full-intensity illumination is in the range of $f0/2 < f \leqq f0$, it causes a phase-advancing operation, resulting in a temporary short-circuit of the high frequency generating means. Therefore, by setting the operating frequency f for full-intensity illumination to be in the range of $f0/3 \leqq f \leqq f0/2$, the invention prevents occurrence of a phase-advancing operation.

According to yet another feature of the invention, a plurality of load circuits are connected in parallel with one another to the output end of the high frequency generating means and are arranged such that a discharge lamp or discharge lamps that have reached the end of life are either darkened or extinguished, while the discharge lamps in normal conditions remain lit.

Therefore, even if one or more discharge lamps come to the end of their lives and the light fades or goes out, the discharge lamps in normal conditions are still in the lit state, thereby preventing the entire luminaire from becoming unilluminated and ensuring the safety.

According to yet another feature thereof, the invention includes an inductor connected in parallel with the load circuit(s).

By connecting an inductor in parallel with the load circuit(s), even if an advancing current flows into the load circuit(s), the lagging current flowing to the inductor offsets the advancing current, thereby increasing the flexibility allowed in the designing and preventing a phase-advancing operation of the high frequency generating means.

According to yet another feature of the invention, when the lighting of a discharge lamp is started, a resonance voltage generated from a higher operating frequency is applied to said discharge lamp.

As a resonance voltage which is higher than, e.g. n times as high as, the operating frequency of the high frequency generating means is generated in the situation where no load is applied, such as the time when the lighting of a discharge lamp is initiated, the high frequency generating means is turned off at the 'n'th half-cycle of the resonance voltage.

According to yet another feature thereof, the invention includes a luminaire that includes a discharge lamp or discharge lamps mounted thereon, and a discharge lamp lighting device for lighting said discharge lamp(s).

The discharge lamp lighting device of said luminaire has the same functions as those of any one of the discharge lamp lighting devices of the present invention described above.

DETAILED DESCRIPTION OF THE PREFERRED EMBODIMENTS

Figure 1:
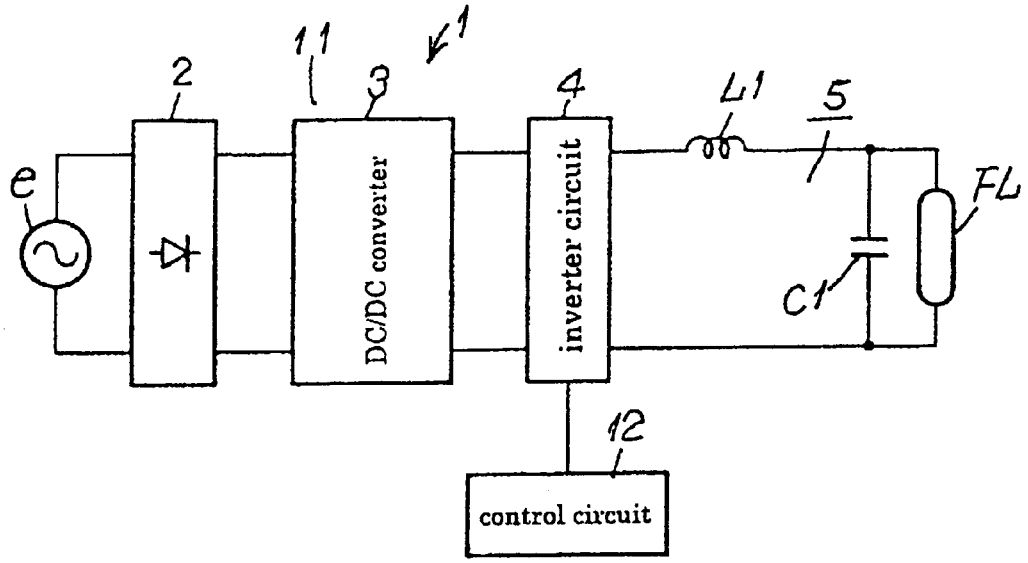
FIG. 1 is a block diagram of a first embodiment of a discharge lamp lighting device according to the present invention.

Embodiments of the present invention are explained hereunder, referring to the drawings.

The following is the explanation of a discharge lamp lighting device according to the first embodiment of the invention referring to FIG. 1. The components and elements corresponding to those of the conventional device described above are referred to with the same reference numerals.

The discharge lamp lighting device 1 according to the first embodiment of the invention shown in FIG. 1 includes a variable DC power source 11 that is comprised of a commercial AC power source e, a full-wave rectifying circuit 2 having an AC input terminal connected to the commercial AC power source e, and a DC/DC converter 3 that may be formed of a boosting chopper circuit serving as a pre-regulator for reducing high harmonics by smoothing the current or other means and is connected to a DC output terminal of the full-wave rectifying circuit 2. An inverter circuit 4 that has a switching means (not shown) and serves as a high frequency generating means is connected to the DC/DC converter 3, and a load circuit 5 is connected to the inverter circuit 4. By changing frequencies by means of a control circuit 12 serving as a control means, the inverter circuit 4 controls the function of the discharge lamp lighting device to perform full-intensity illumination and dimming.

Via an inductor L1, which serves as a current limiting element, the load circuit 5 is connected to a fluorescent lamp FL having a small diameter tube and serving as a discharge lamp that has a base and a filament, which is a hot cathode, at each end of the glass bulb of the lamp. A start-up capacitor C1 for starting the fluorescent lamp FL by resonance at the time of starting-up is connected in parallel with the fluorescent lamp FL.

A load characteristic imposing means 14 is comprised of the inverter circuit 4, the inductor L1 and the capacitor C1.

Next, the function of the first embodiment described above is explained.

First, full-wave rectification of the AC voltage from the commercial AC power source e is conducted by the full-wave rectifying circuit 2, and the rectified voltage is then converted to DC voltage as it is smoothed and adjusted by the DC/DC converter 3. When the DC voltage is input to the inverter circuit 4, the inverter circuit 4 generates a high frequency voltage at variable frequencies, and the generated voltage is applied to the load circuit 5. At the load circuit 5, the high frequency voltage input thereto is applied via the inductor L1 to the fluorescent lamp FL and the capacitor C1. The fluorescent lamp FL and the capacitor C1 generate an appropriate resonance so that a high voltage necessary for the starting up of the fluorescent lamp FL is applied to the fluorescent lamp FL, thereby lighting the fluorescent lamp FL.

When the fluorescent lamp FL is lit at a full intensity, the lamp exhibits such load characteristics as a relatively low release voltage and a large short-circuit current. When the fluorescent lamp FL is in the dimming mode, the lamp exhibits such load characteristics as a relatively high release voltage and a low short-circuit current.

Figure 2:
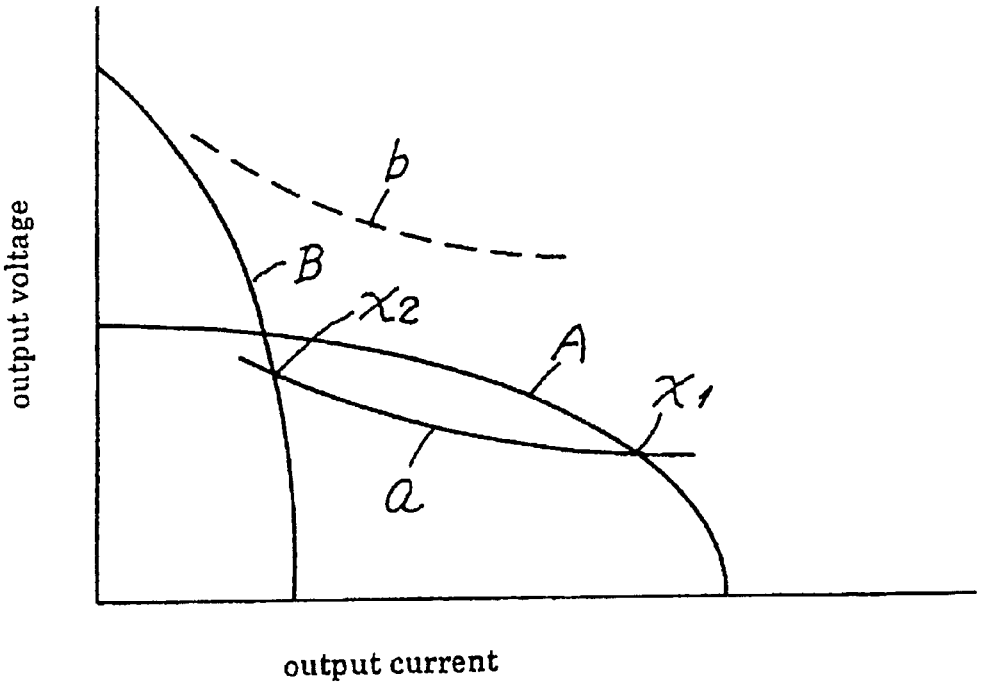
FIG. 2 is a graph representing load characteristics of a load circuit of the discharge lamp lighting device shown in FIG. 1.

As shown in FIG. 2, wherein the curve A and the curve B respectively represent the load characteristics of the load circuit 5 in the full-intensity illumination mode and the dimming mode, there is a large amount of short-circuit current in contrast to a low release voltage during the period when the full-intensity illumination is conducted. The short-circuit current is shoen as the value of the output current as the output voltage approaches zero on curves A and B.

In the dimming mode, however, the release voltage is high while the amount of shortcircuit current is small. In the drawing, the curve a represents the operating characteristics of the fluorescent lamp FL functioning in normal conditions, while the curve b represents the operating characteristics of the fluorescent lamp FL that is close to the end of its life.

When the fluorescent lamp FL is functioning normally, the intersection point X1 between the load characteristic curve A and the operating characteristic curve a acts as the operating point.

When the fluorescent lamp FL has entered the last stage of its life, its operating characteristics changes such that they are represented by the curve b. As the lamp voltage is higher than the release voltage, the operating characteristic curve b does not intersect with the load characteristic curve A. As a result, the fluorescent lamp FL becomes unable to remain lit and, therefore, becomes unilluminated.

Thus, the embodiment described above is capable of preventing the regions of the glass bulb near its filaments, the bases or the socket of the fluorescent lamp FL from melting.

Throughout the dimming mode, the intersection point X2 between the load characteristic curve B and the operating characteristic curve a acts as the operating point.

Figure 4:
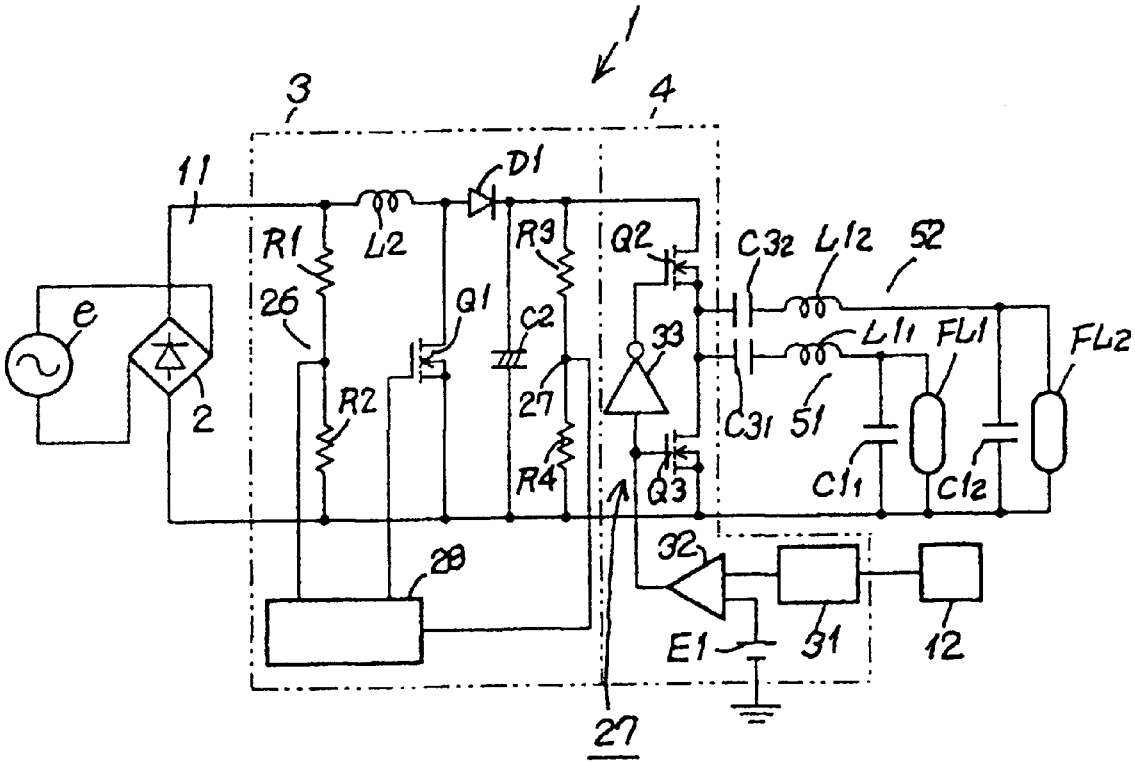
FIG. 4 is a circuit diagram of a second embodiment of a discharge lamp lighting device according to the invention.

Next, a discharge lamp lighting device 1 according to the second embodiment of the invention is explained hereunder, referring to FIG. 4.

Figure 3:
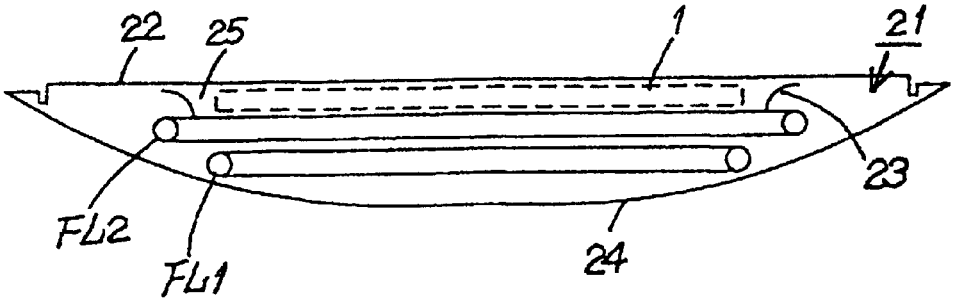
FIG. 3 is a schematic illustration of a luminaire according to the invention, shown in a cross section.

The discharge lamp lighting device 1 shown in FIG. 4 is attached to a luminaire 21 shown in FIG. 3, which is a household luminaire 21 of a ceiling-mounted type to be directly mounted onto a ceiling.

As shown in FIG. 3, the luminaire 21 includes a shallow, circular dish-shaped chassis 22 that serves as a lighting fixture and has a means to attach it to a ceiling is mounted on a ceiling. A translucent cover 24 is attached to the underside of the chassis 22.

The chassis 22 also has a reflection plate 23, which is formed as shallow as possible in order to make the entire luminaire 21 as thin as possible. Fluorescent lamps FL1,FL2 serving as discharge lamps are concentrically arranged and disposed so as to face the reflection plate 23. The translucent cover 24 is disposed over the chassis 22, reflection plate 23 and the fluorescent lamps FL1,FL2 in such a manner as to enclose them. The reflection plate 23 is formed in such a shape as to enable the translucent cover 24 to reflect the light from the fluorescent lamps FL1,FL2 as uniformly as possible. The discharge lamp lighting device 1 excluding the fluorescent lamps FL1,FL2 is disposed in the space 25 between the chassis 22 and the reflection plate 23.

The fluorescent lamps FL1,FL2 are circular lamps of a small diameter-tube type having an outer tube diameter of 16.5 mm and are respectively identified by the product types of FHC27 and FHC34. Both fluorescent lamps FL1,FL2 are designed to perform high-output illumination at the respective power consumption of 38W and 48W in the full-intensity illumination mode.

The discharge lamp lighting device 1 includes a commercial AC power source e, a fullwave rectifying circuit 2, and a DC/DC converter 3 connected to the full-wave rectifying circuit 2. The DC/DC converter 3 comprises a series circuit of an inductor L2 and a field-effect transistor Q1 connected to a point between the DC output terminals of the full-wave rectifying circuit 2, and a series circuit of a diode D1 and a capacitor C2 connected to the field-effect transistor Q1, wherein the field-effect transistor Q1 serves as a switching means. The DC/DC converter 3 also includes a series circuit of resistors R1,R2 of an input voltage detecting circuit 26 and a series circuit of resistors R3,R4 of an output voltage detecting circuit 27, the resistors R1,R2 connected to an output terminal of the full-wave rectifying circuit 2, which is located at the input side of the DC/DC converter 3, and the resistors R3,R4 connected in parallel with the capacitor C2, which is located at the output side of the DC/DC converter 3.

A junction point between the resistor R1 and the resistor R2 of the input voltage detecting circuit 26 and a junction point between the resistor R3 and the resistor R4 of the output voltage detecting circuit 27 are connected to a control circuit 28, which is connected to the gate of the field-effect transistor Q1. Based on the voltages detected by the input voltage detecting circuit 26 and the output voltage detecting circuit 27, the control circuit 28 controls switching of the field-effect transistor Q1 in order to maintain the output voltage from the DC/DC converter 3 at a constant level. A variable DC power source 11 is comprised of the commercial AC power source e, the full-wave rectifying circuit 2 and the DC/DC converter 3.

A half-bridge inverter circuit 4 is connected to the DC/DC converter 3. The inverter circuit 4 is comprised of a pair of field-effect transistors Q2,Q3 connected in series with each other to a point between the output terminals of the DC/DC converter 3 and serving as a switching means. An oscillator 31 is connected to a control circuit 12. While the oscillator 31 is connected to one of the input ends of a comparator 32, a reference voltage E1 is connected to the other input end of the comparator 32. The output end of the comparator 32 is connected to the gate of the field-effect transistor Q3, and also to the gate of the field-effect transistor Q2 via an inverter circuit 33. Two load circuits 51,52 are connected, in parallel with each other, to both ends of the field-effect transistor Q3 that serves as the output terminal of the inverter circuit 4.

The load circuit 51 is connected to an FHC-type fluorescent lamp FL1 via a DC interrupting capacitor C31 and an inductor L11, which serves as a current limiting element. A start-up capacitor C11 for starting the fluorescent lamp FL1 by resonance at the initiation of lighting is connected to the fluorescent lamp FL1 in parallel therewith. In the same manner as the load circuit 51, the load circuit 52 is connected to an FHC-type fluorescent lamp FL2 via DC interrupting capacitor C32 and an inductor L12, which serves as a current limiting element. A start-up capacitor C12 for starting the fluorescent lamp FL2 by resonance at the initiation of lighting is connected to the fluorescent lamp FL2 in parallel therewith.

Next, the function of the discharge lamp lighting device 1 of the second embodiment described above is explained.

First, full-wave rectification of the AC voltage from the commercial AC power source e is conducted by the full-wave rectifying circuit 2.

The DC/DC converter 3 detects the input voltage with the input voltage detecting circuit 26 and detects the output voltage with the output voltage detecting circuit 26, and, based on the input voltage and output voltage detected as above, the DC/DC converter 3 turns the field-effect transistor Q1 on or off by means of the control circuit 28, thereby charging the capacitor C2 with the boosted voltage.

The inverter circuit 4 functions in such a manner that its control circuit 12 controls the oscillator 31 to permit the comparator 32 to compare the voltage with the reference voltage E1 and turns the field-effect transistor Q2 and the field-effect transistor Q3 alternately on and off to output a high frequency voltage. The inverter circuit 33 switches the field-effect transistor Q2 and the field-effect transistor Q3 such that when one of them is turned on, the other field-effect transistor is turned off and vice versa.

The oscillator 31 changes frequencies so that the fluorescent lamps FL1,FL2 exhibit such load characteristics as a relatively low release voltage and a large amount of short-circuit current when the fluorescent lamps FL1,FL2 are lit at the full luminosity and a relatively high release voltage and a low short-circuit current when the lamps are in the dimming mode. Therefore, a smooth starting-up is ensured without the danger of the fluorescent lamps FL1,FL2 being lit in the state where they are not yet sufficiently preheated. Furthermore, should one of the fluorescent lamps FL1,FL2 reach the end of its life during full-intensity illumination, it becomes unilluminated due to a low release voltage, while the other fluorescent lamp FL1,F2, which has not yet reached the end of its life, remains in the full-intensity illumination mode.

In other words, even when one of the fluorescent lamps FL1,FL2 reaches the end of its life, the embodiment described above is capable of preventing the entire luminaire from becoming dark.

Each fluorescent lamp of the luminaire 21 according to the embodiment described above has a bulb having an outer diameter of 16.5 mm. In other words, they are narrower than the fluorescent lamps FL1,FL2 of a conventional luminaire, which typically have an outer tube diameter of 29 mm. The embodiment of the invention is thus capable of reducing the height or the depth of the chassis 22 by an average of nearly 40%, thereby providing a lighting fixture which will not look overwhelming even if it is installed in a room having a relatively low ceiling, such as one in a condominium.

The lamps of the embodiment have a rated life of 9,000 hours, which is 1.5 times as long as 6,000 hours of an ordinary fluorescent lamp.

Furthermore, the embodiment does not require a complicated protective circuit to turn off a fluorescent lamps FL1 or FL2 that has reached the end of the life, thereby preventing abnormal increase of temperature which tends to occur at the end of the life of a small diameter type fluorescent lamp FL1,FL2. Thus, the embodiment is capable of preventing the glass bulb, the base or the socket from melting due to such an abnormal increase of temperature.

As mentioned above, by using fluorescent lamps FL1,FL2 having different rated power consumption, the luminaire 21 can be designed to be suitable for a household lighting, which may include concentrically arranged circular lamps having different radiuses.

Figure 5:
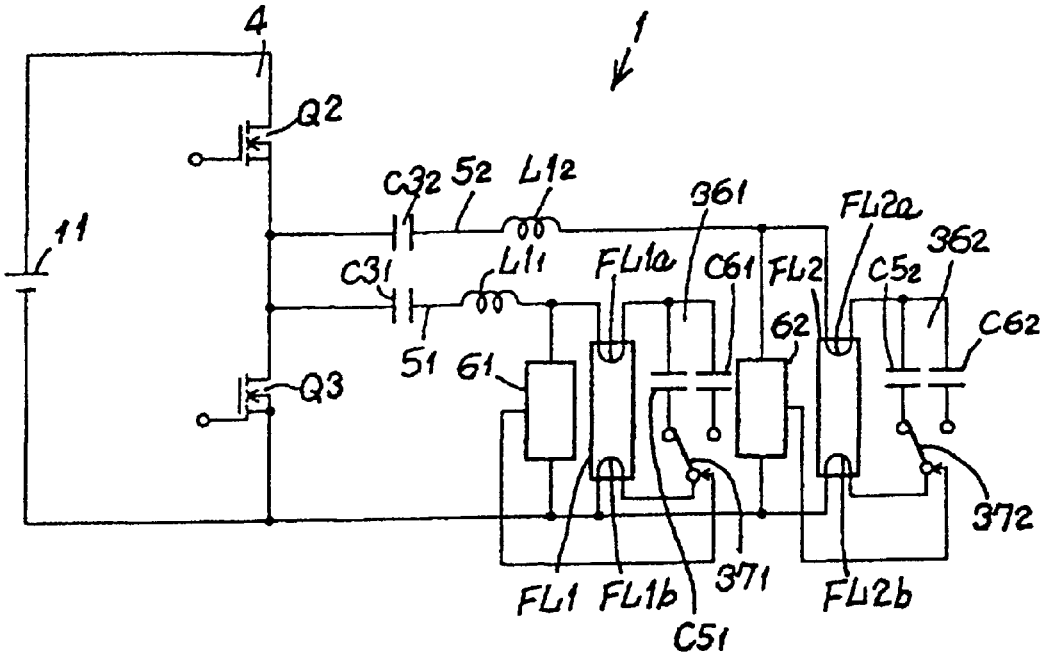
FIG. 5 is a circuit diagram of a third embodiment of a discharge lamp lighting device according to the invention.

Next, the discharge lamp lighting device 1 according to the third embodiment of the invention is explained, referring to FIG. 5.

The discharge lamp lighting device 1 according to the third embodiment has the same configuration as that of the discharge lamp lighting device 1 according to the second embodiment except that the field-effect transistor Q3 is connected via the capacitor $C3_1$, and the inductor $L1_1$ to one end (hereinafter called the first end) of the filament FL1*a* and one end (hereinafter called the first end) of the filament FL1*b*, said two filaments serving as the hot cathodes of the fluorescent lamp FL1. The field-effect transistor Q3 is also connected, via the capacitor $C3_2$ and the inductor $L1_2$, to one end (the first end) of the filament FL2*a* and one end (the first end) of the filament FL2b, said filaments FL2*a*,FL2*b* serving as the hot cathodes of the fluorescent lamp FL2. A life-end detecting circuit 61 adapted to detect termination of the life of the fluorescent lamp FL1 by detecting the voltage between the terminals of the fluorescent lamp FL1 is connected to said first ends of the filament FL1*a* and the filament FL1*b*. Likewise, a life-end detecting circuit 62 adapted to detect termination of the life of the fluorescent lamp FL2 by detecting the voltage between the terminals of the fluorescent lamp FL2 is connected to the first ends of the filament FL2*a* and the filament FL2*b*.

A capacity changing circuit 36, for starting the fluorescent lamp FL1 is connected to the other ends (hereinafter called the second ends) of the filaments FL1*a*,FL1*b* of the fluorescent lamp FL1, while a capacity changing circuit $36_2$ for starting the fluorescent lamp FL2 is connected to the other ends (the second ends) of the filaments FL2*a*,FL2*b* of the fluorescent lamp FL2. The capacity changing circuit 36, is comprised of a capacitor $C5_1$ for normal operation and a capacitor $C6_1$, for the life-end mode and having a capacity smaller than that of the $C5_1$, said capacitors $C5_1$,$C6_1$ connected in parallel with each other in such a manner that they may be selectively switched by means of a changeover switch $37_1$, adapted to be controlled by the life-end detecting circuit 61. The capacity changing circuit $36_2$ is comprised of a capacitor $C5_2$ for normal operation and a capacitor $C6_2$ for the life-end mode and having a capacity smaller than that of the $C5_1$, said capacitors $C5_2$,$C6_2$ connected in parallel with each other in such a manner that they may be selectively switched by means of a changeover switch $37_2$ adapted to be controlled by the life-end detecting circuit 62.

When both fluorescent lamps FL1,FL2 are working properly, their life-end detecting circuits 61,62 respectively switch the changeover switches $37_1$,$37_2$ so that the capacitors $C5_1$,$C5_2$ become electrically connected to light the fluorescent lamps FL1,FL2 with normal load characteristics.

When either one of the life-end detecting circuit 61 or 62 switches the changeover switches $37_1$ or $37_2$ associated therewith upon the fluorescent lamp FL1 or FL2 corresponding to said life-end detecting circuit having reached the end of its life, the capacitor $C6_1$ or $C6_2$ associated therewith is electrically connected so that the release voltage on the corresponding load circuit 51,52 is reduced. As a result, the fluorescent lamp FL1,FL2 that has been detected to reach the end of the life becomes unilluminated without fail, while the other fluorescent lamp FL1,FL2 remains lit.

Figure 6:
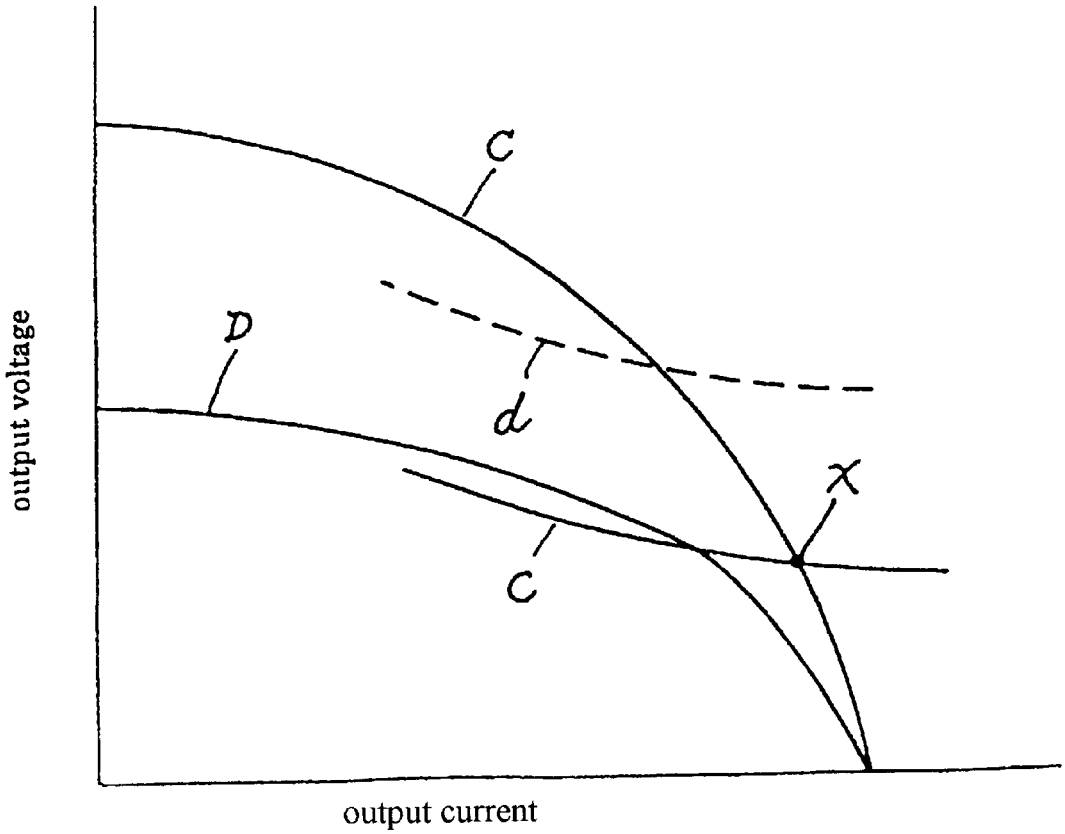
FIG. 6 is a graph representing load characteristics of the load circuit of the discharge lamp lighting device shown in FIG. 5.

The load characteristics of the load circuits 51,52 are shown in FIG. 6, wherein the curve C represents the load characteristics of each load circuit when the capacitor for normal operation, i.e. the capacitor $C5_1$ or $C5_2$, is electrically connected, while the curve D represents the load characteristics of each load circuit when the capacitor $C6_1$ or $C6_2$ for the life-end mode is electrically connected. The curve c and the curve d respectively represent the operating characteristics of each fluorescent lamp FL1,FL2 functioning in normal conditions and those in the last stage of the life of the lamp.

Each fluorescent lamp FL1,FL2 is lit at the intersection point X between the load characteristic curve C and the operating characteristic curve c when it is operating in normal conditions.

When one of the fluorescent lamps FL1,FL2, e.g. the fluorescent lamp FL1, reaches the end of its life, the corresponding switch, i.e. the changeover switch $37_1$ in this case, switches the connection to the load circuit 51 so that the capacitor C61 is electrically connected to the load circuit 51, thereby reducing the release voltage. As the load characteristic changes to the level represented by the load characteristic curve D, the operating characteristic of the fluorescent lamp FL1 changes to the level represented by the operating characteristic curve d. Because the lamp voltage is increased, the load characteristic curve D and the operating characteristic curve d do not intersect with each other. As a result, the fluorescent lamp FL1 becomes unable to remain lit and therefore unilluminated. The other fluorescent lamp FL2 is maintained in the lit state, because the capacitor $C5_2$ for normal operation is in the connected state.

Figure 7:
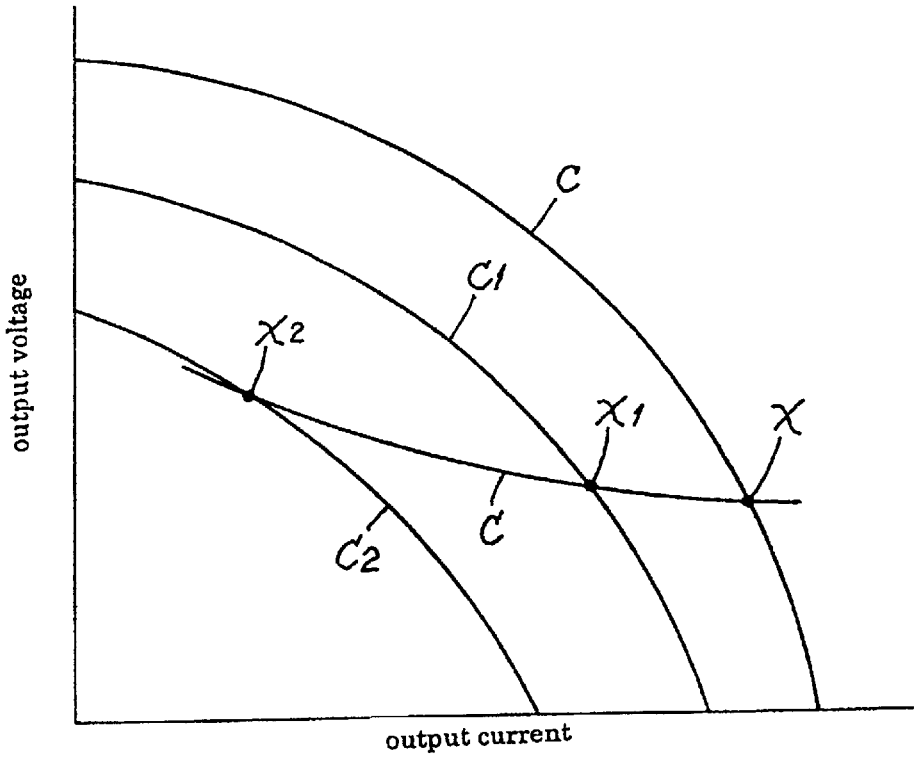
FIG. 7 is a graph representing load characteristics of the load circuit shown in FIG. 5 when the discharge lamps are continuously dimmed.

As shown in FIG. 7, which illustrates the load characteristics during the period when dimming is continuously conducted, the degree of dimming is increased by increasing the output frequency of the inverter circuit 4 from the level at which the full intensity illumination is conducted and represented by the load characteristic curve C. Together with the increase in the extent of the dimming, the load characteristic curve shifts from C1 to C2, and the function point shifts from the point X through the intersection point X1 to the intersection point X2. Thus, the lamp is continuously dimmed.

Figure 8:
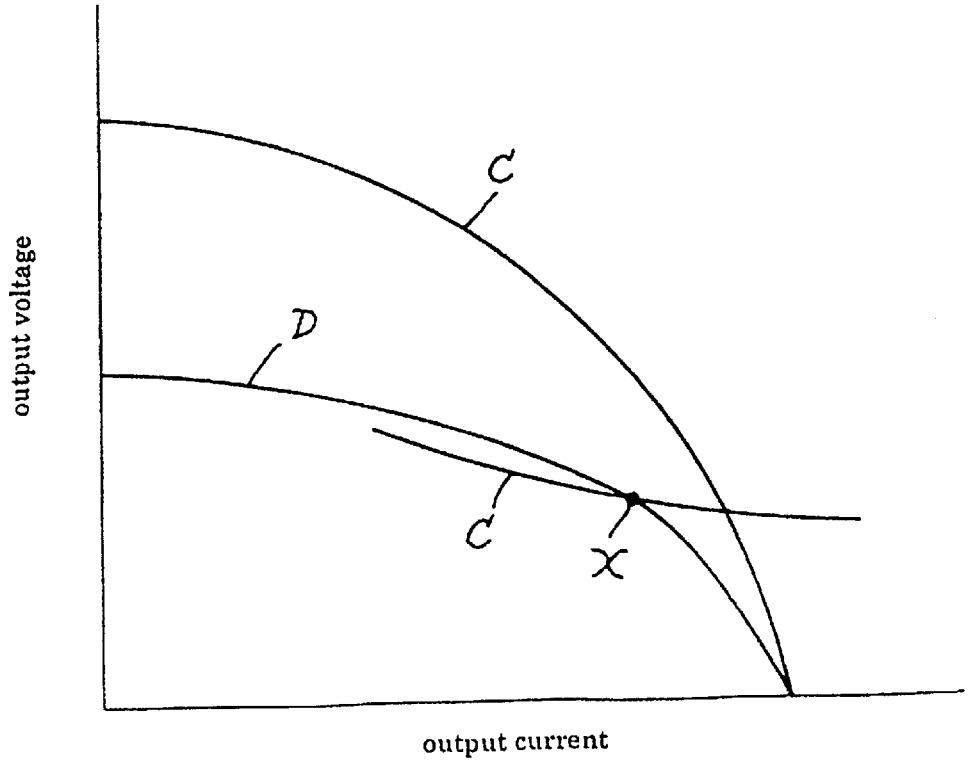
FIG. 8 is a graph representing load characteristics of the load circuit shown in FIG. 5 in cases where the load circuit is switched to a second capacitor at the time of starting up and switched to a first capacitor after the lamps become illuminated.

As shown in FIG. 8, the load characteristics in cases where the connection is switched to the capacitors $C6_1$,$C6_2$ for the life-end mode at the time of starting up and switched to the normal capacitors $C5_1$,$C5_2$ after the fluorescent lamps FL1,FL2 become lit. By connecting the life-end the capacitors $C6_1$,$C6_2$ at the starting up, the starting up is facilitated with a high release voltage applied to the fluorescent lamps FL1,FL2 as shown by the load characteristic curve C in FIG. 8.

As the connection is thereafter switched to the capacitors $C5_1$,$C5_2$ for normal operation, the load characteristics become such that they are represented by the load characteristic curve D, and the fluorescent lamps FL1,FL2 are lit at the intersection point X that acts as the operating point. When a fluorescent lamp FL1 or fluorescent lamp FL2 comes to the end of the life, the lamp at the end of the life becomes unilluminated, because its load characteristic curve D does not intersect with the operating characteristic curve at the end of the life.

Figure 9:
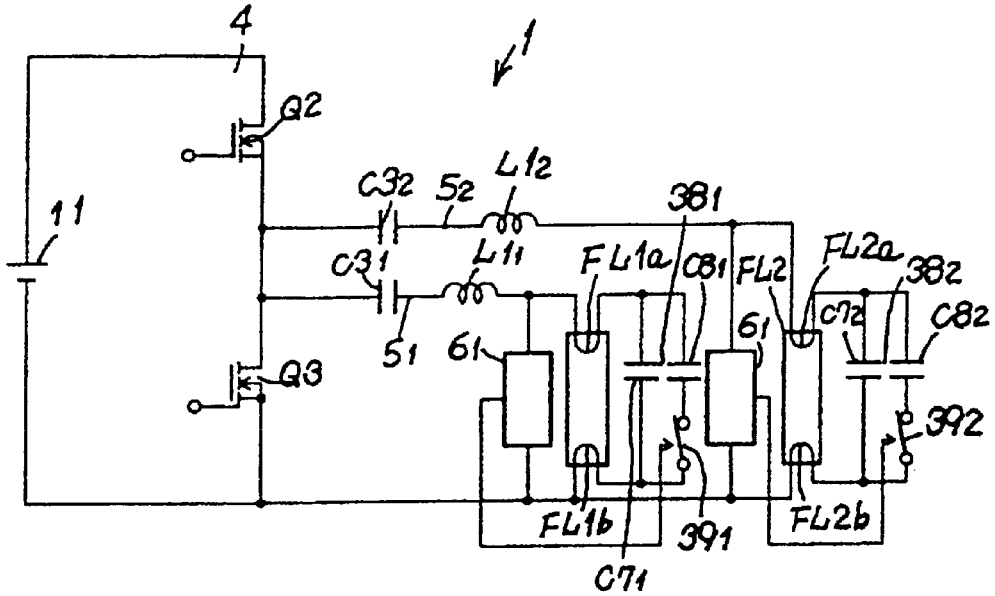
FIG. 9 is a circuit diagram of a fourth embodiment of a discharge lamp lighting device according to the invention.

Next, the discharge lamp lighting device 1 according to the fourth embodiment of the invention is explained, referring to FIG. 9.

The discharge lamp lighting device 1 according to the fourth embodiment has the same configuration as that of the discharge lamp lighting device 1 according to the third embodiment except that capacity changing circuits $38_1$,$38_2$ are included instead of the capacity changing circuits $36_1$, $36_2$. To be more specific, the capacity changing circuit $38_1$ comprises a capacitor $C7_1$, a capacitor $C8_1$ and a changeover switch 391, which is adapted to be controlled by the life-end detecting circuit 61, and these capacitors $C7_1$,$C8_1$, and the changeover switch $39_1$ are connected in parallel with one another. The capacity changing circuit 382 comprises a capacitor $C7_2$, a capacitor $C8_2$ and a changeover switch 392, which is adapted to be controlled by the life-end detecting circuit 62, and these capacitors $C7_2$,$C8_2$ and the changeover switch $39_2$ are connected in parallel with one another.

When both fluorescent lamps FL1,FL2 are in normal conditions, their respective life-end detecting circuits 61,62 close the changeover switches $39_1$,$39_2$ to respectively connect the capacitors $C7_1$,$C7_2$ in parallel with the capacitors $C8_1$,$C8_2$, thereby increasing the combined capacity of each pair of capacitors to a level virtually the same as the capacity of each respective capacitor $C5_1$,$C5_2$ of the third embodiment so that the load circuits 51,52 light the fluorescent lamps FL1,FL2 with normal load characteristics.

When either the fluorescent lamp FL1 or fluorescent lamp FL2 reaches the end of its life, its life-end detecting circuit 61,62 opens the changeover switch $39_1$,$39_2$ to disconnect the corresponding capacitor $C8_1$,$C8_2$, so that the capacitor $C7_1$ or $C7_2$ alone is connected. As a result, the capacity is reduced to a level virtually the same as the capacity of each respective capacitor $C6_1$,$C6_2$ of the third embodiment so that the release voltage on the corresponding load circuit 51,52 is reduced and that the load circuit in question turns off the fluorescent lamp FL1,FL2 that has reached the end of its life and maintains the other fluorescent lamp FL1,FL2, which is in normal conditions, in the lit state.

The basic function of the fourth embodiment described above is the same as that of the third embodiment.

Figure 10:
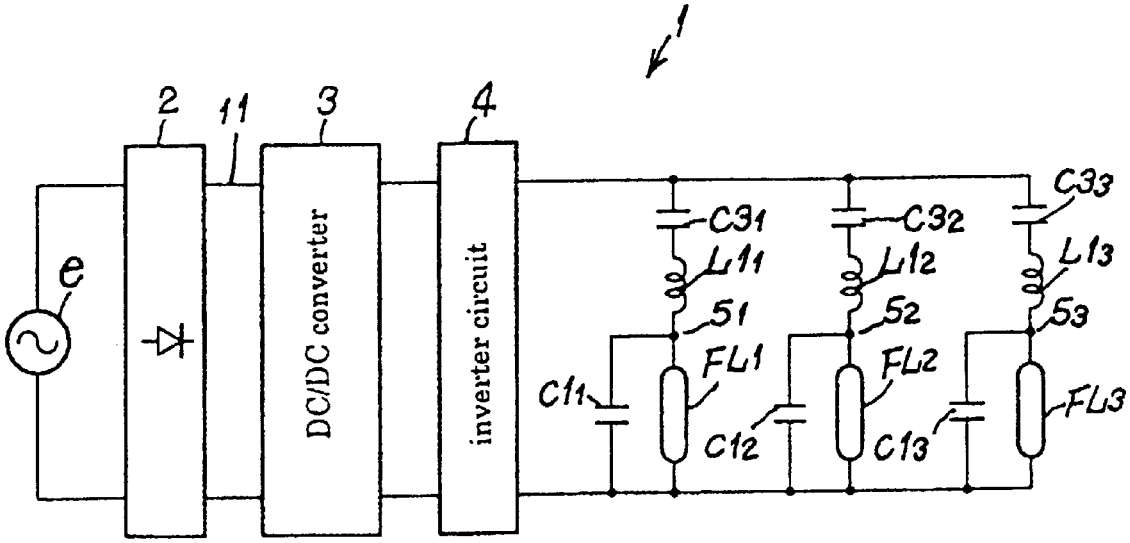
FIG. 10 is a circuit diagram of a fifth embodiment of a discharge lamp lighting device according to the invention.

Next, the discharge lamp lighting device 1 according to the fifth embodiment of the invention is explained, referring to FIG. 10.

The discharge lamp lighting device 1 according to the fifth embodiment has the same configuration as that of the discharge lamp lighting device 1 according to the first embodiment except that three load circuits 51,52,53 are connected in parallel with one another to a single inverter circuit 4 to be shared by these load circuits. To be more specific, the load circuit 51 includes a capacitor $C1_1$ and a series circuit consisting of a capacitor $C3_1$, an inductor $L_1$, and a fluorescent lamp FL1, said capacitor $C1_1$ connected in parallel with the fluorescent lamp FL1. The load circuit 52 includes a capacitor $C1_2$ and a series circuit consisting of a capacitor $C3_2$, an inductor $L1_2$ and a fluorescent lamp FL2, the capacitor $C1_2$ connected in parallel with the fluorescent lamp FL1. The load circuit 53 includes a capacitor $C1_3$ and a series circuit consisting of a capacitor $C3_3$, an inductor $L1_3$ and a fluorescent lamp FL3, said capacitor $C1_3$ connected in parallel with the fluorescent lamp FL3.

The fluorescent lamps FL1,FL2,FL3 may have different rated power consumption. In this case, the inductances of the inductors $L1_1$,$L1_2$,$L1_3$ should respectively be adjusted to pass desired amounts of lamp currents.

The intrinsic resonance frequencies of the respective load circuits 51,52,53 can be set at desired levels by selecting frequency levels of the capacitors $C3_1$,$C3_2$,$C3_3$ and the inductors $L1_1L1_2$,$L1_3$.

By setting the frequency output from the inverter circuit 4 sufficiently lower than the intrinsic resonance frequencies of the load circuits 51,52,53 when the fluorescent lamps FL1,FL2,FL3 are lit at full intensity, a fluorescent lamp FL1,FL2,FL3 becomes unilluminated when it reaches the end of the life, while the other fluorescent lamps FL1,FL2, FL3 that are in normal conditions remain lit. Furthermore, as thus setting the output frequency prevents resonance between the fluorescent lamps FL1,FL2,FL3 and the capacitors $C1_1$,$C1_2$,$C1_3$, which are connected in parallel with the fluorescent lamps FL1,FL2,FL3, and permits the inductors $L1_1$,$L1_2$,$L1_3$ to merely act as impedances, thereby reducing the release voltages. The release voltages in this case is almost entirely determined by the output power from the inverter circuit 4.

Figure 11:
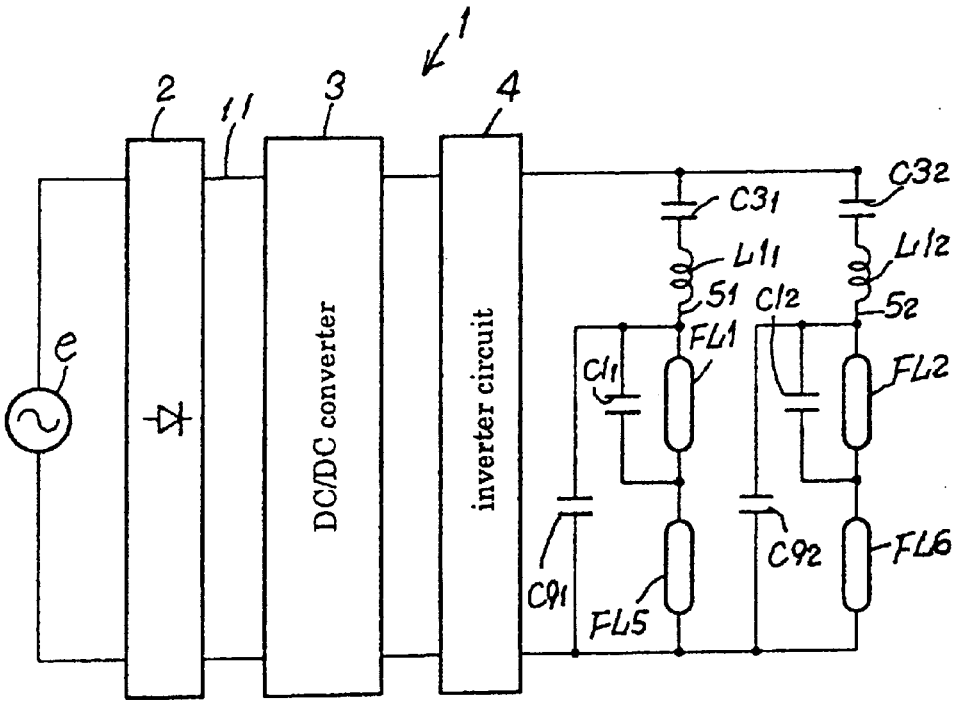
FIG. 11 is a circuit diagram of a sixth embodiment of a discharge lamp lighting device according to the invention.

Next, the discharge lamp lighting device 1 according to the sixth embodiment of the invention is explained, referring to FIG. 11.

The discharge lamp lighting device 1 according to the sixth embodiment has the same configuration as that of the discharge lamp lighting device 1 according to the first embodiment except that two load circuits 51,52 are connected in parallel with each other to a single inverter circuit 4, which is to be shared by these load circuits and that two pairs of fluorescent lamps, i.e. fluorescent lamps FL1,FL5 and fluorescent lamps FL2,FL6, are respectively connected in to the load circuits 51,52, wherein the fluorescent lamps FL1,FL5 are connected in series with each other, and the fluorescent lamps FL2,FL6, too, are connected in series with each other. In other words, the load circuit 51 is comprised of a series circuit consisting of a capacitor $C3_1$, an inductor $L_1$, the aforementioned fluorescent lamp FL1 and the fluorescent lamp FL5; a start-up capacitor $C1_1$ connected in parallel with the fluorescent lamp FL1; and a capacitor $C9_1$ connected in parallel with the series circuit of the fluorescent lamp FL1 and the fluorescent lamp FL5. The load circuit 52 is comprised of a series circuit consisting of a capacitor $C3_2$, an inductor $L1_2$, the aforementioned fluorescent lamp FL2 and the fluorescent lamp FL6; a start-up capacitor $C1_2$ connected in parallel with the fluorescent lamp FL2; and a capacitor $C9_2$ connected in parallel with the series circuit of the fluorescent lamp FL2 and the fluorescent lamp FL6.

When the high frequency voltage output from the inverter circuit 4 is applied to the load circuits 51,52, all the voltage is applied through the capacitors $C3_1$,$C3_2$ to both ends of each respective fluorescent lamp FL5,FL6, thereby lighting these fluorescent lamps FL5,FL6 so that the starting up begins with the fluorescent lamps FL5,FL6.

As the voltage is intensively applied to both ends of each respective fluorescent lamp FL1,FL2 thereafter, the fluorescent lamps FL1,FL2 become illuminated, following the other two lamps. Thus, the starting up is conducted sequentially.

Figure 12:
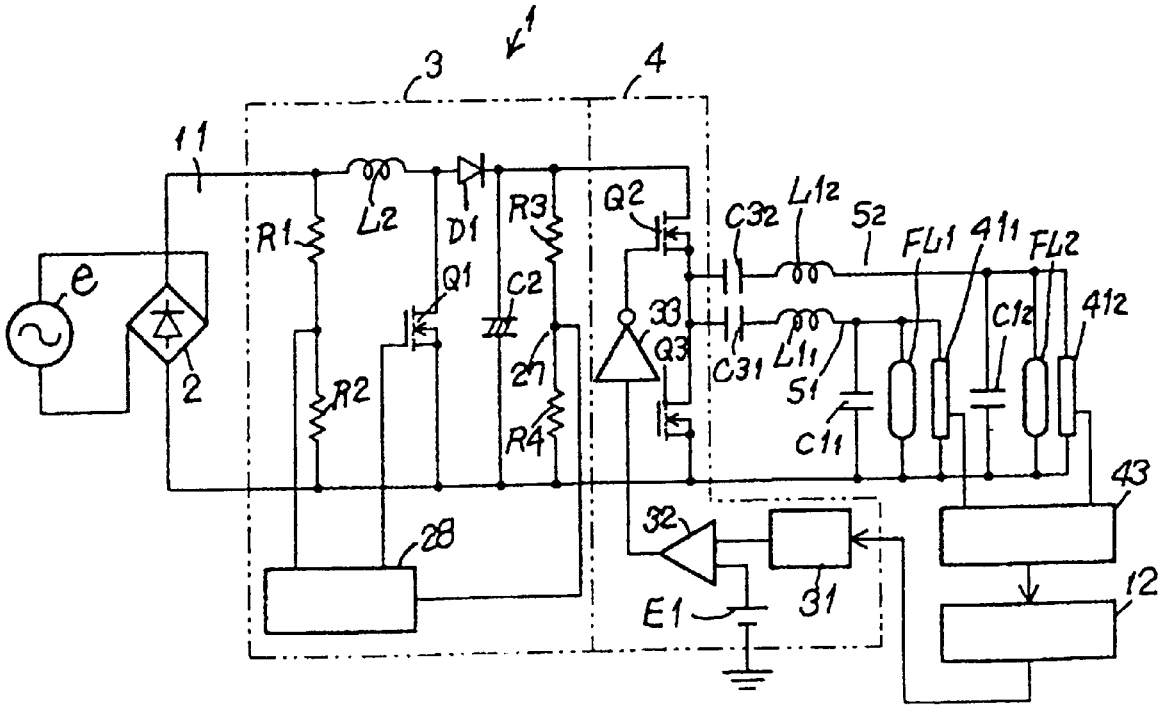
FIG. 12 is a circuit diagram of a seventh embodiment of a discharge lamp lighting device according to the invention.

Next, the discharge lamp lighting device 1 according to the seventh embodiment of the invention is explained, referring to FIG. 12.

The discharge lamp lighting device 1 according to the seventh embodiment has the same configuration as that of the discharge lamp lighting device 1 according to the second embodiment except that the device includes a lamp voltage detecting circuit $41_1$ connected in parallel with the fluorescent lamp FL1; a lamp voltage detecting circuit $41_2$ connected in parallel with the fluorescent lamp FL2; and a judging circuit 43 connected to the control circuit 12 and serving as a judging means for judging, based on the lamp voltages detected by said lamp voltage detecting circuit $41_1$,$41_2$, whether there is a fluorescent lamp that has come to the end of its life. The basic function of this embodiment is the same as that of the second embodiment. Specifically, if one of the fluorescent lamps, e.g. the fluorescent lamp FL1, comes to the end of its life, the lamp voltage detected by the lamp voltage detecting circuit $41_1$ increases, and the judging circuit 43 judges that a life-end situation has occurred. The control circuit 12 then reduces the oscillation frequency of the inverter circuit 4 to reduce the release voltage, thereby turning off the fluorescent lamp FL1 at the life end. Meanwhile, the fluorescent lamp FL2 that is in normal conditions remains lit in spite of the reduced output voltage of the inverter circuit 4, because the voltage between both ends of the FL2 is low.

In case one of the fluorescent lamps FL1,FL2 comes to the end of its life during dimming, the frequency of the inverter circuit 4 is reduced in the same manner as described above so that the lighting mode is changed to the full-intensity lighting mode where the output voltage from the inverter circuit 4 is low. Therefore, even if one of the fluorescent lamps FL1,FL2 comes to the end of its life during dimming, during which time the output voltage from the inverter circuit 4 is high, the configuration according to the seventh embodiment ensures the reliable extinguishing of the fluorescent lamp FL1,FL2 that has reached the end of the life.

Figure 13:
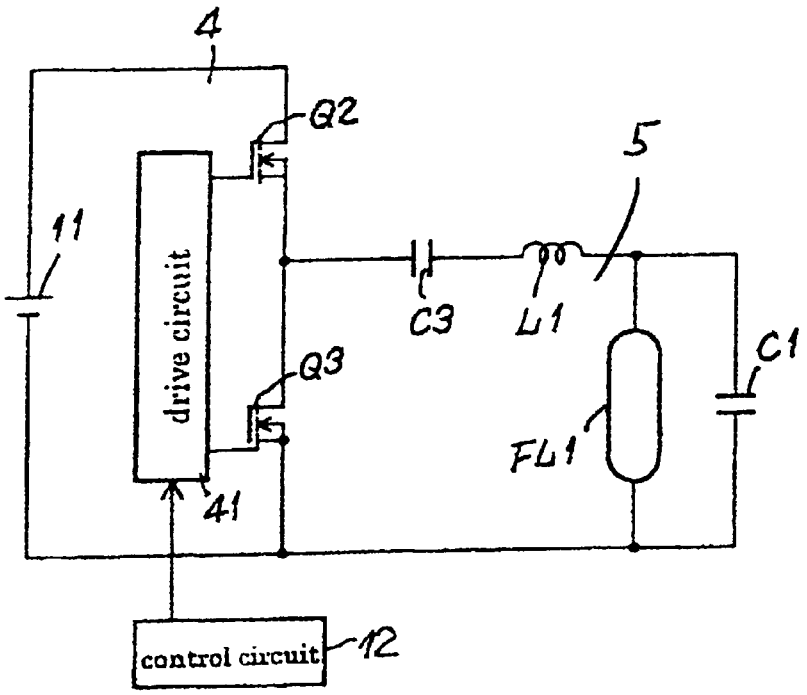
FIG. 13 is a circuit diagram of an eighth embodiment of a discharge lamp lighting device according to the invention.

Next, the discharge lamp lighting device 1 according to the eighth embodiment of the invention is explained, referring to FIG. 13.

The discharge lamp lighting device 1 according to the eighth embodiment has the same configuration as that of the discharge lamp lighting device 1 according to the second embodiment except that the inverter circuit 4 is of a current resonance type and adapted to control the frequencies of the field-effect transistor Q2 and the field-effect transistor Q3 by use of a drive circuit 41 in accordance with the control circuit 12, which controls full-intensity lighting and dimming.

The operating frequencies of the inverter circuit 4 are set such that the frequency f1 for full-intensity illumination and the frequency f2 for dimming are respectively set at 50 Khz and 105 KHz. The fluorescent lamp FL1 is of an FHC34 type. The inductor L1 is set at 1.15 mH; the capacitor C1 at 2200 pH; the capacitor C3 at 0.1 $\mu$F; and the intrinsic resonance frequency f0 of the load circuit 5 at 100 KHz.

Further, the discharge lamp lighting device 1 functions similarly in cases where the inductor L1, the capacitor C1, the intrinsic resonance frequency of the load circuit 5 and the frequency in the full-intensity illumination mode are set at, for example, 1.3 mH, 1500 pH, 114 KHz and 45 KHz respectively.

Figure 14:
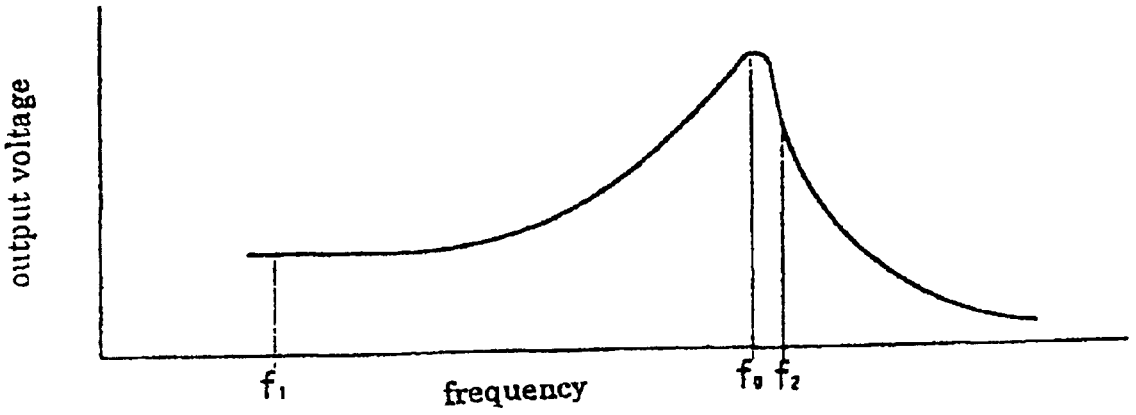
FIG. 14 is a graph representing frequency characteristics of the load circuit of the discharge lamp lighting device shown in FIG. 13.

As shown in FIG. 14, wherein the intrinsic resonance frequency of the load circuit 5, the frequency in the full-intensity illumination mode and the frequency in the dimming mode are respectively represented by f0, f1 and f2, the frequency characteristics of the load circuit 5 are such that the frequency f1 in the full-intensity illumination mode is sufficiently lower than the intrinsic resonance frequency f0 of the load circuit 5, and the output voltage during the full luminosity lighting, too, is relatively low. In contrast to this, the frequency f2 in the dimming mode is higher than the intrinsic resonance frequency f0 of the load circuit 5, and the output voltage is higher than the voltage in the full-intensity illumination mode.

Figure 15:
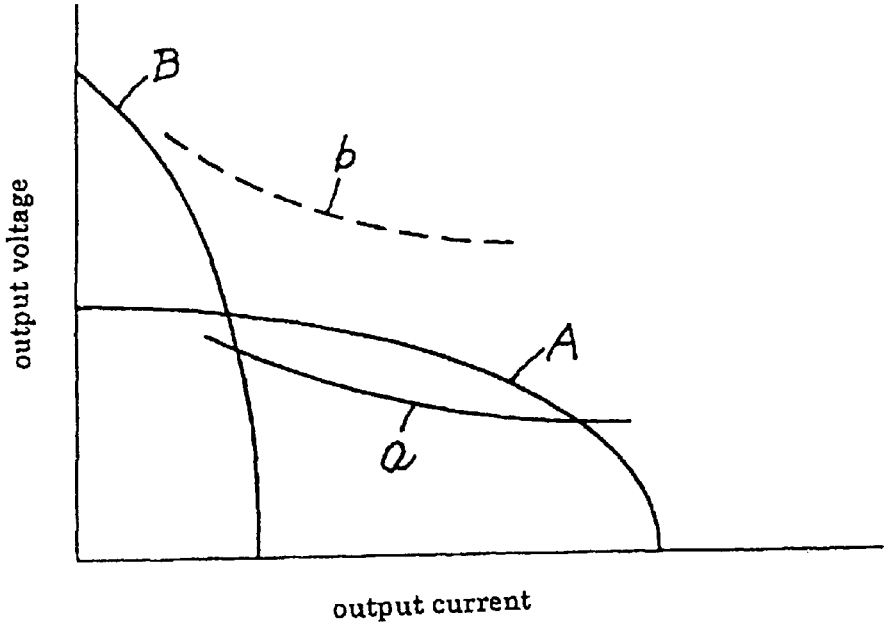
FIG. 15 is a graph representing load characteristics of the load circuit of the discharge lamp lighting device shown in FIG. 13.

As shown in FIG. 15, wherein the curve A and the curve B respectively represent the load characteristics in the full-intensity illumination mode and the load characteristics in the dimming mode, the load characteristics of the load circuit 5 are such that the release voltage is low when the fluorescent lamp FL1 is lit at the full luminosity, while the amount of the short-circuit current is large. As the frequency f1 in the full-intensity illumination mode is sufficiently lower than the intrinsic resonance frequency f0, the inductor L1 alone acts as the current-limiting element so that the release voltage is reduced.

In contrast to the above, the release voltage is high when the fluorescent lamp FL1 is being dimmed, while the amount of the short-circuit current is small.

As shown in FIG. 15, when the fluorescent lamp FL1 is in normal conditions, its operating characteristics in the initial stage of lighting are represented by the curve a. During the course of its operating life, however, the operating characteristics shifts upward to those represented by the curve b in the last stage of its life. At the last stage of the life of the fluorescent lamp FL1, the lamp voltage, which is determined by the operating characteristics, is higher than the release voltage, which is determined by the load characteristic curve A. In other words, no intersecting point that functions as the operating point is formed. Therefore, the fluorescent lamp FL1 is unable to remain lit and, in consequence, becomes unilluminated.

Another benefit of the above embodiment lies in its simple circuit configuration, wherein the capacity of the capacitor C1 is reduced so as to set the intrinsic resonance frequency f0 to be sufficiently higher than the frequency f1 for the full-intensity illumination mode.

Figure 16:
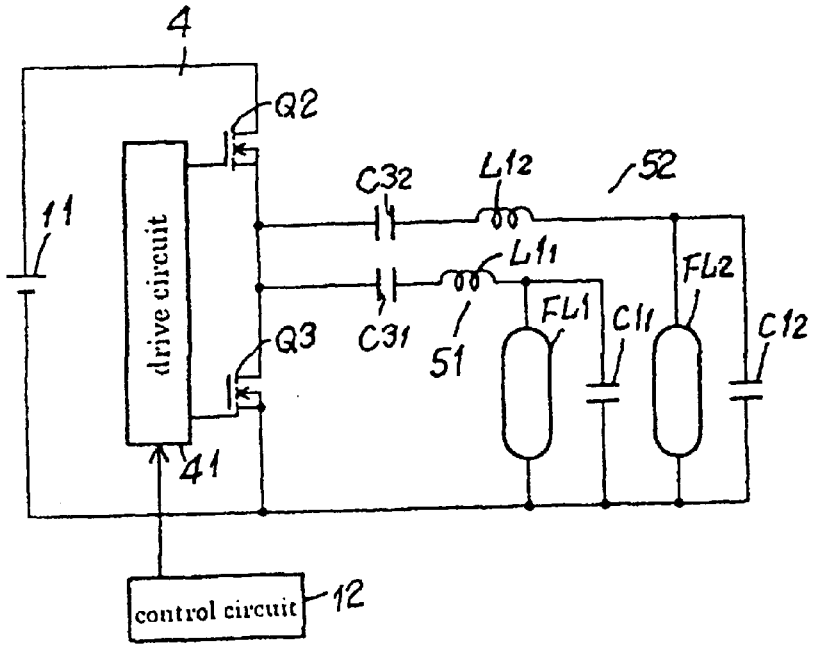
FIG. 16 is a circuit diagram of a ninth embodiment of a discharge lamp lighting device according to the invention.

Next, the discharge lamp lighting device 1 according to the ninth embodiment of the invention is explained, referring to FIG. 16.

The discharge lamp lighting device 1 according to the ninth embodiment has the same configuration as that of the discharge lamp lighting device 1 according to the second embodiment except that, in the same manner as the discharge lamp lighting device 1 according to the eighth embodiment, the discharge lamp lighting device 1 is provided with a plurality of load circuits, e.g. two load circuits 51,52, as well as two fluorescent lamps FL1,FL2. The fluorescent lamps FL1,FL2 may have different power consumption on condition that there is not a great difference between their starting voltages.

Figure 17:
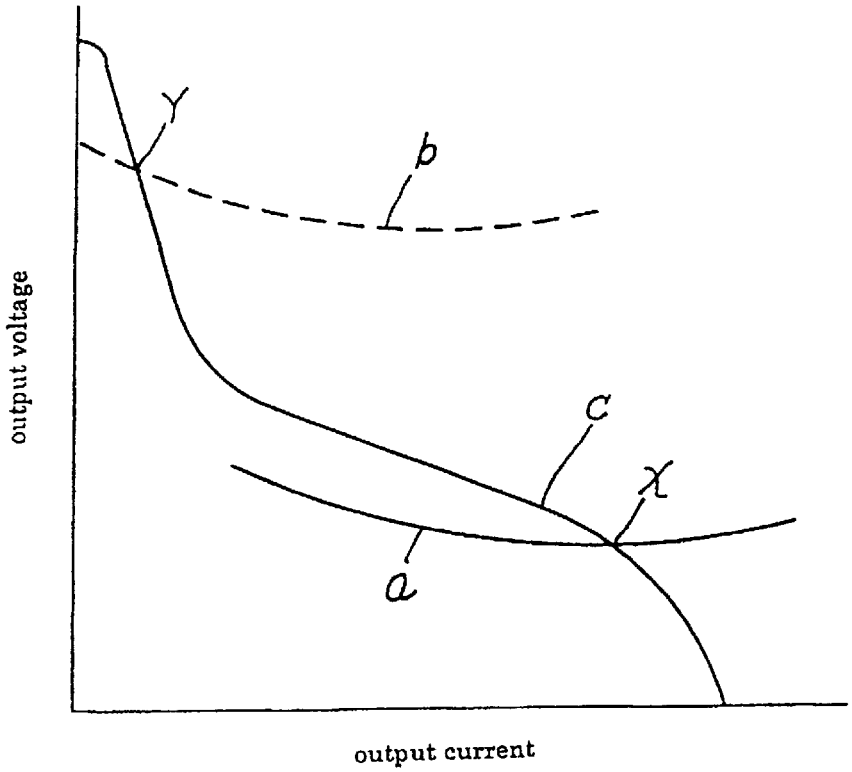
FIG. 17 is a graph representing load characteristics of the load circuit of the discharge lamp lighting device shown in FIG. 16.

The load characteristics of the load circuits 51,52 are shown in FIG. 17, wherein the curve C represents the load characteristics of each load circuit 51,52; the curve a represents the operating characteristics of each fluorescent lamp FL1,FL1 in the full-intensity illumination mode when said fluorescent lamp is working in normal conditions; and the curve b represents the operating characteristics of said fluorescent lamp FL1,FL1 when it is in the last stage of its life. As shown in FIG. 17, the load characteristics of the load circuits 51,52 are set such that the output voltage is high in the range where the amount of the output current is large and that the output voltage drastically increases in the range where the amount of the output current is small. Therefore, each fluorescent lamp FL1,FL2 functions properly throughout the course of full-intensity illumination with the intersection point X between the load characteristic curve C and the operating characteristic curve a acting as the operating point. During the course of its operating life, the operating characteristics of each fluorescent lamp FL1,FL2 gradually shifts upward until they are represented by the curve b when the lamp reaches the last stage of its life. Therefore, when either fluorescent lamp FL1,FL2 reaches the last stage of its life, its load characteristic curve C intersects with the operating characteristic curve b in the range where the amount of the output current is small so that the fluorescent lamp FL1,FL2 operates only at the intersection point Y. In other words, even if the fluorescent lamp FL1 or the fluorescent lamp FL2 is lit in the state where it is close to the end of its life, its luminous intensity is substantially reduced, thereby preventing abnormal increase of the temperature of the vicinity of the filaments of the fluorescent lamp FL1,FL2 and also making it easy to recognize that the fluorescent lamp FL1,FL2 is at the end of its life.

Figure 18:
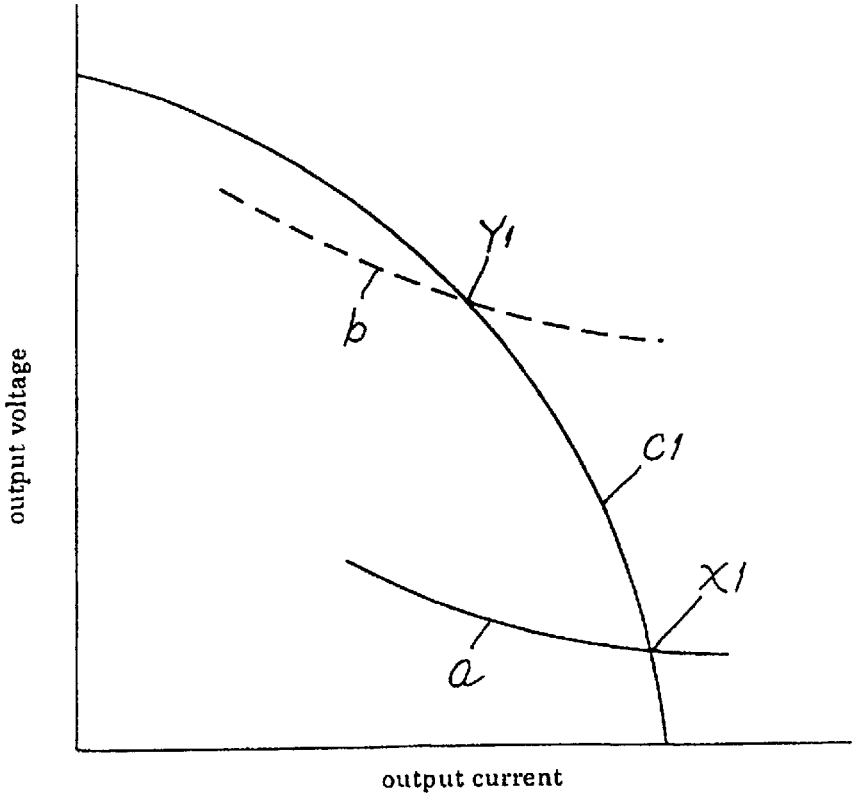
FIG. 18 is a graph representing load characteristics of the load circuit of a comparative example.

As shown in FIG. 18, the load characteristics of the load circuit of the conventional device form an arc-like shape, such as the curve C1 in FIG. 18, and there is not a large difference between the output current at the intersection point X1 and the output current at the intersection point Y1 where the operating characteristic curve b of the fluorescent lamp at the end of its life and the load characteristic curve C1 intersect with each other. Therefore, because of a symmetric operating condition, the temperature of the regions around the filaments tends to become excessively high when the lamp reaches the last stage of its life.

Figure 19:
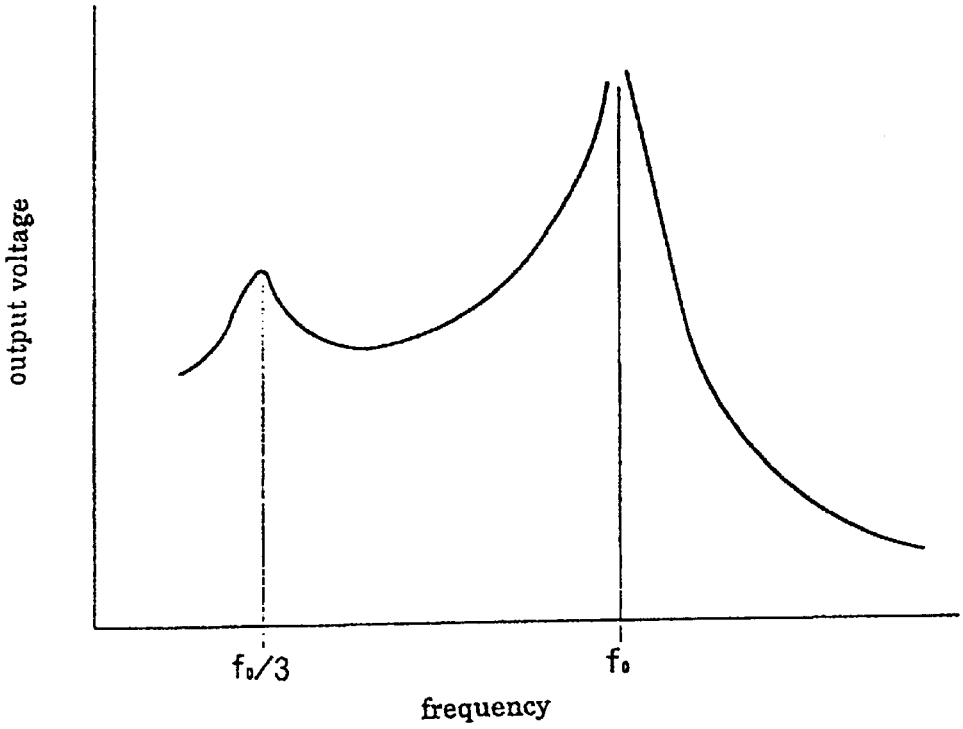
FIG. 19 is a graph representing frequency characteristics of the load circuit of the discharge lamp lighting device shown in FIG. 16.

As shown in FIG. 19, the frequency characteristics of each load circuit of the 9th embodiment are such that a relatively small, low-level resonance occurs when the frequency is f0/3 with respect to the intrinsic resonance frequency f0 of the load circuit 51,52 at the time of starting up, during which no load is applied, and a tertiary high harmonic resonance can be generated by setting the start-up output frequency at a level near the frequency of f0/3. Doing so also enables the lagged-phase switching. The frequency to be set is not limited to f0/3; as long as it is set in the range between the frequency f0/3 and the frequency f0/2, phase-advancing operation will not easily occur.

Figure 20:
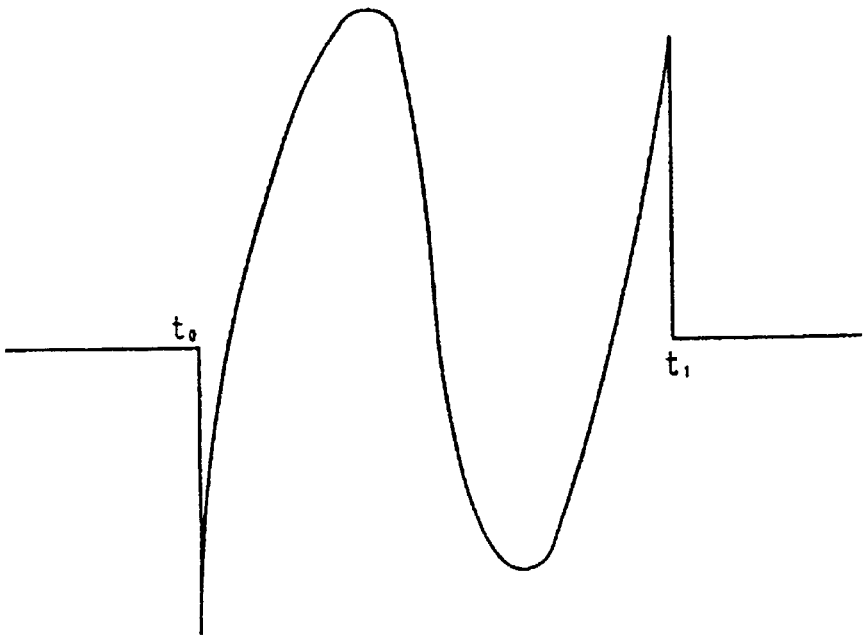
FIG. 20 is a waveform illustration showing the waveform of the current passing a switching means of the discharge lamp lighting device shown in FIG. 16 at the initiation of lighting.

The waveform of the current flowing through the field-effect transistor Q3 is shown in FIG. 20, wherein the time t0 and the time t1 respectively represent the duration of the 'on' state and the duration of the 'off' state of the field-effect transistor Q3. As shown in FIG. 20, when the field-effect transistor Q3 is turned on in the period where no load is applied, i.e. at the time of starting up, a tertiary high harmonic resonance is generated with respect to the operating frequency of the inverter circuit 4 so that the resonance current passes the field-effect transistor Q3. Therefore, the field-effect transistor Q3 is turned off at some point in the third half-cycle when the current passes therethrough. As the phase of the current at that time is a delayed phase, the tertiary resonance provides a release voltage at a desired high level, thereby facilitating the starting up of the fluorescent lamps FL1,FL2, although the burden imposed on the field-effect transistor Q3 is light.

Figure 21:
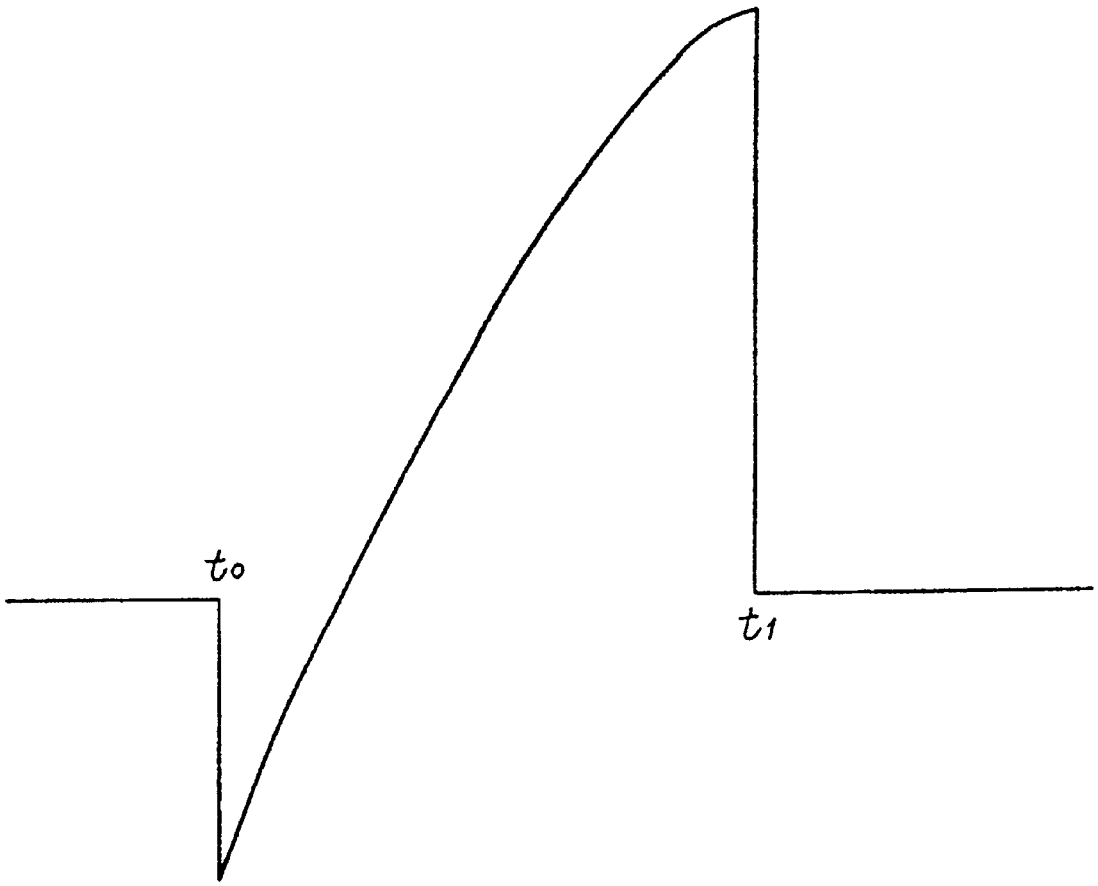
FIG. 21 is a graph showing the waveform of the current passing a switching means of the discharge lamp lighting device of said comparative example at the initiation of lighting.

As shown in the current waveform in FIG. 21, the current passing a field-effect transistor that serves as a switching element of the conventional device does not generate a higher resonance. Therefore, the field-effect transistor is turned off at the first half-cycle and is therefore unable to increase the release voltage by means of resonance.

Figure 22:
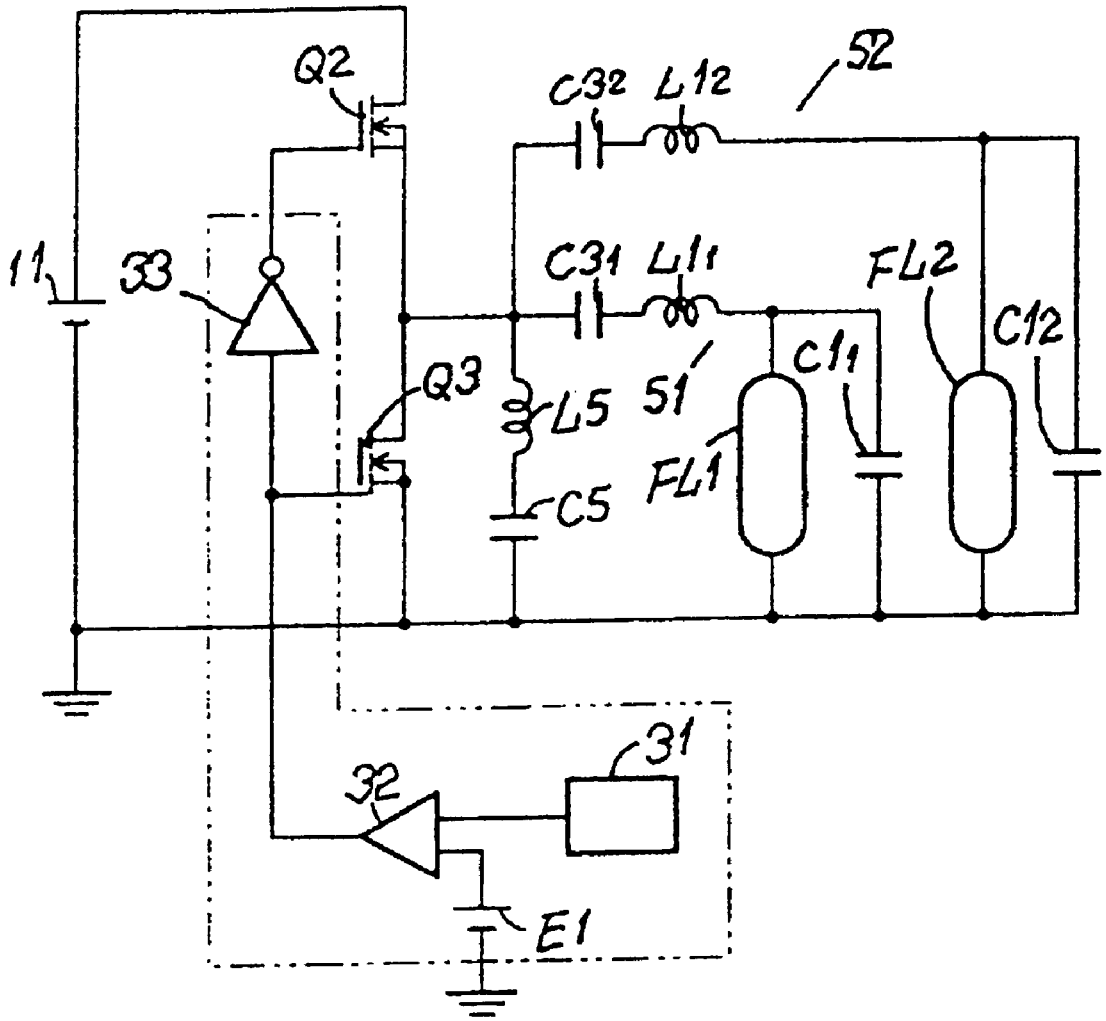
FIG. 22 is a circuit diagram of a tenth embodiment of a discharge lamp lighting device according to the invention.

Next, the discharge lamp lighting device 1 according to the tenth embodiment of the invention is explained, referring to FIG. 22.

The discharge lamp lighting device 1 according to the tenth embodiment has the same configuration as that of the discharge lamp lighting device 1 according to the second embodiment except that a series circuit of an inductor L5 and a capacitor C5 is connected in parallel with the field-effect transistor Q3. The series circuit of the inductor L5 and the capacitor C5 is also connected in parallel with the load circuits 51,52.

Although the basic function of this embodiment is the same as that of the discharge lamp lighting device 1 according to the second embodiment, a feature of the present embodiment lies in that a lagging current flows into the inductor L5, which is connected in parallel with the load circuits 51,52. Therefore, even if a certain amount of advancing current flows into the load circuits 51,52, the advancing current is compensated for so that a lagging current is ensured to flow into the inverter circuit 4.

Figure 23:
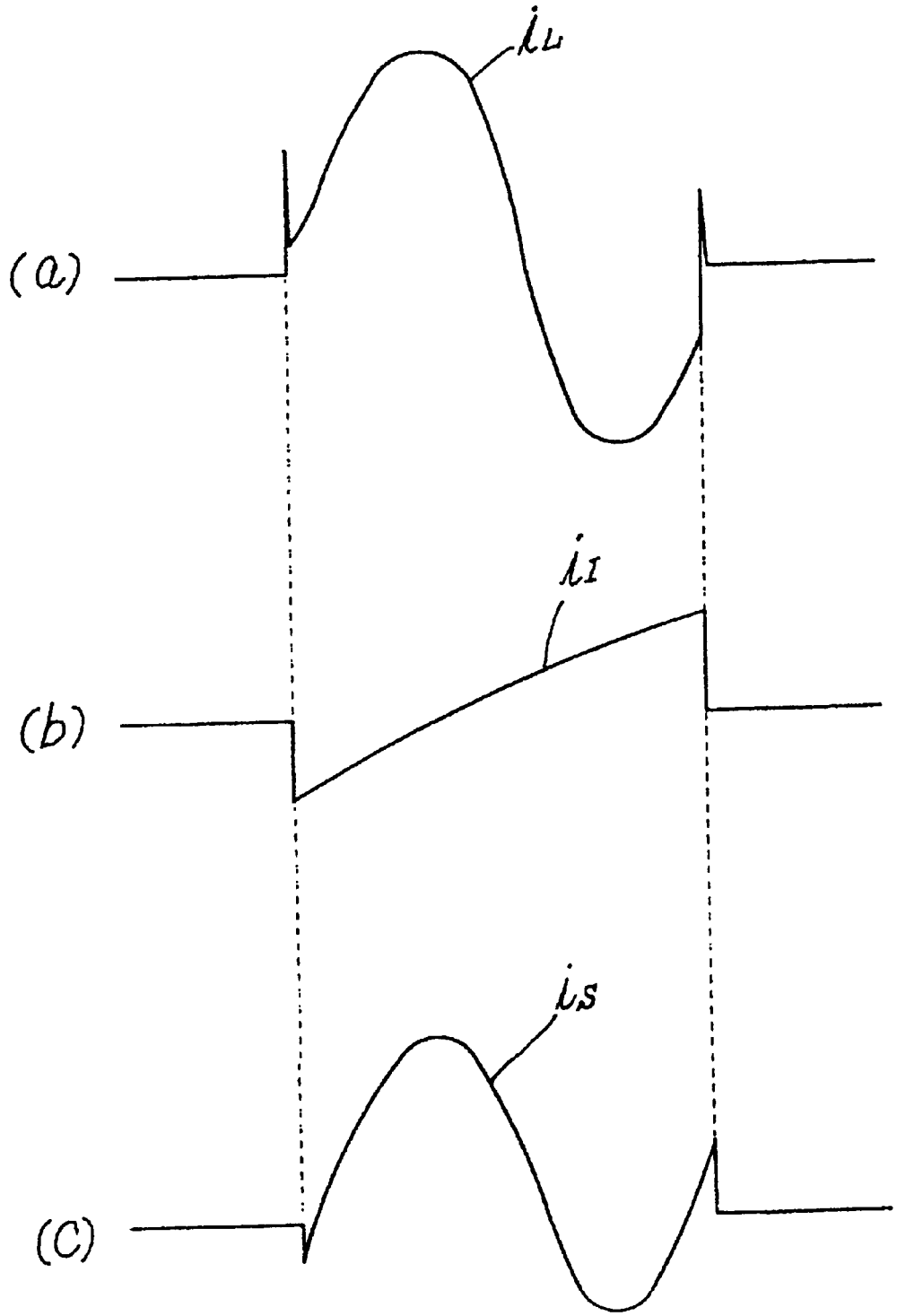
FIG. 23 is a waveform illustration showing the waveforms of the current passing various components of the discharge lamp lighting device shown in FIG. 22 when no load is applied.

As shown in FIG. 23, when no load is applied to the discharge lamp lighting device 1, the current iL flow into the load circuits 51,52; the current il flows into the inductor L5; and the current iS flows into field-effect transistor Q3. In cases where the flow of current iL into the load circuits 51,52 is used as the reference for timing, the current iL is an advancing current, while the current iI is a lagging current. As the current iS flowing into the field-effect transistor Q3 is a combined current of the current iL and the current iI, the current iS can be made a lagging current as shown in the drawing by setting the capacitor C5 and the inductor L5 at appropriate values. As the 10th embodiment thus facilitates the formation of a lagging current, it increases the flexibility allowed in the design.

Figure 24:
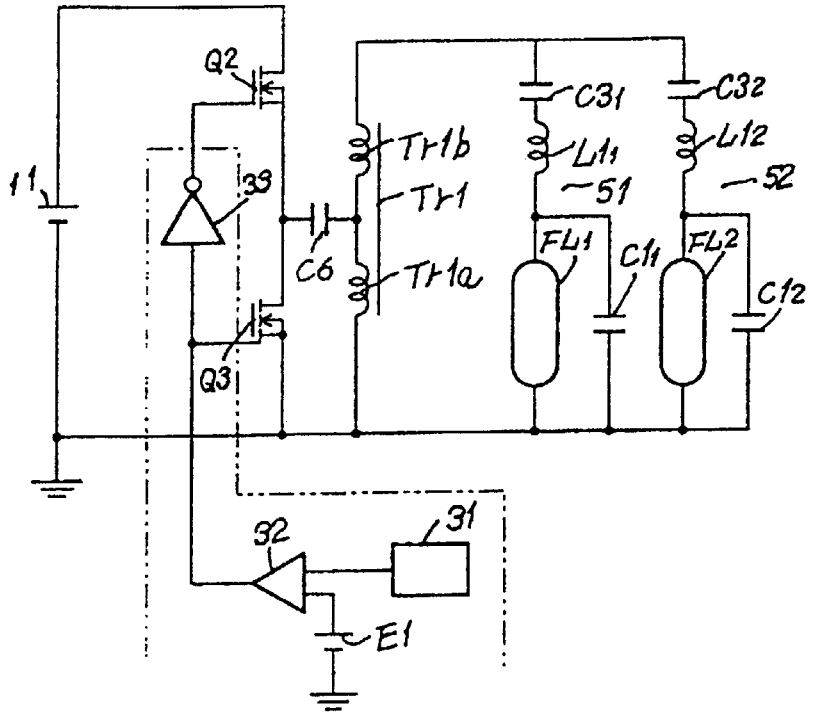
FIG. 24 is a circuit diagram of an eleventh embodiment of a discharge lamp lighting device according to the invention.

Next, the discharge lamp lighting device 1 according to the 11th embodiment of the invention is explained, referring to FIG. 24.

The discharge lamp lighting device 1 according to the 11th embodiment has the same configuration as that of the discharge lamp lighting device 1 according to the second embodiment except that a capacitor C6 and a primary winding Tr1*a* of a transformer Tr1 connected in series with each other are connected in parallel with the field-effect transistor Q3 and that one end of a secondary winding Tr1*b* of the transformer Tr1 is connected to a junction point where the capacitor C6 and the primary winding TR1*a* of the transformer TR1 are connected, while the other end of the secondary winding TR1*b* of the transformer TR1 is connected to the capacitors $C3_1$,$C3_2$. Said transformer TR1 is of a short winding type and serves as an inductor.

Although the basic function of this embodiment is the same as that of the discharge lamp lighting device 1 according to the 10th embodiment, a feature of the present embodiment lies in that the voltage can be adjusted to a level required by the load circuits 51,52 by boosting with the transformer TR1 and that the lagging exciting current which flows into the primary winding TR1*a* of the transformer TR1 can be circulated back to the field-effect transistor Q3.

Figure 25:
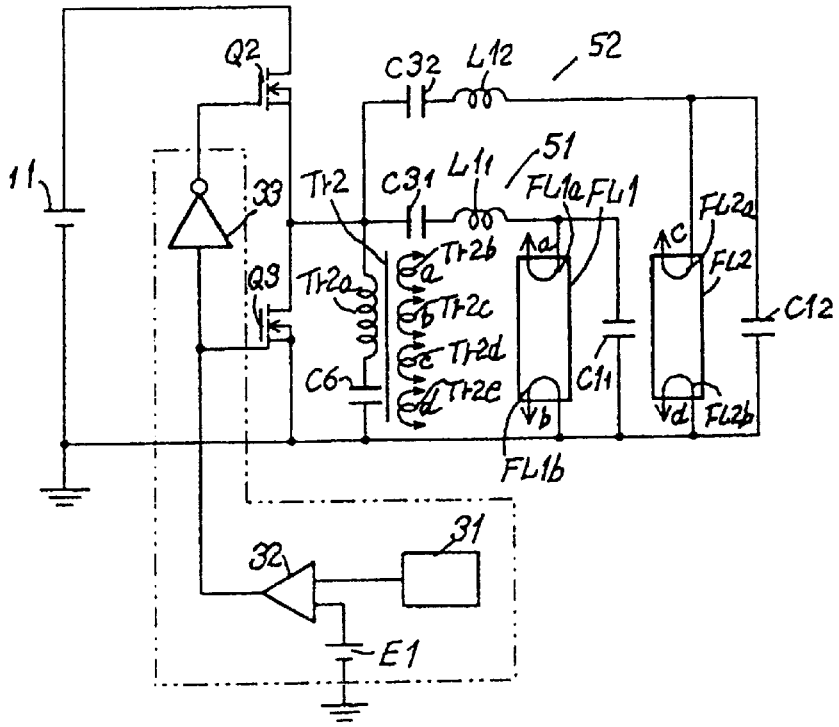
FIG. 25 is a circuit diagram of a twelfth embodiment of a discharge lamp lighting device according to the invention.
Figure 26:
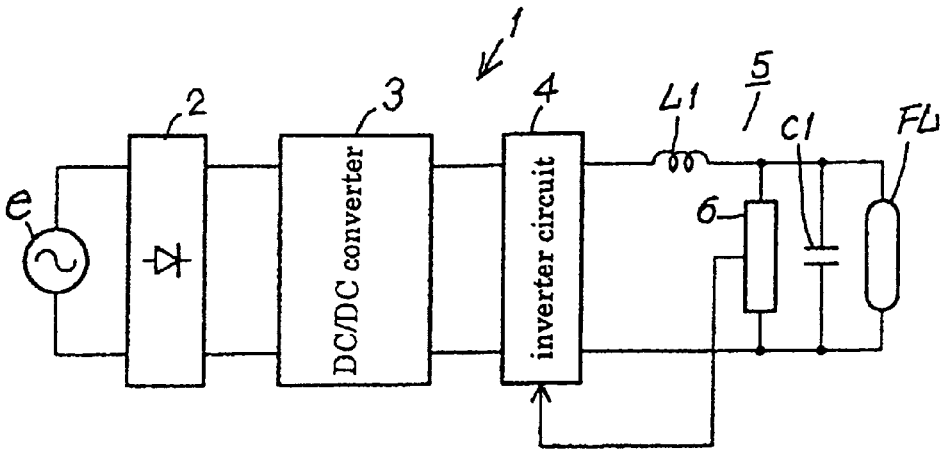
PRIOR ART Fig. 26
FIG. 26 is a circuit diagram of an example of conventional discharge lamp lighting devices.
Figure 27:
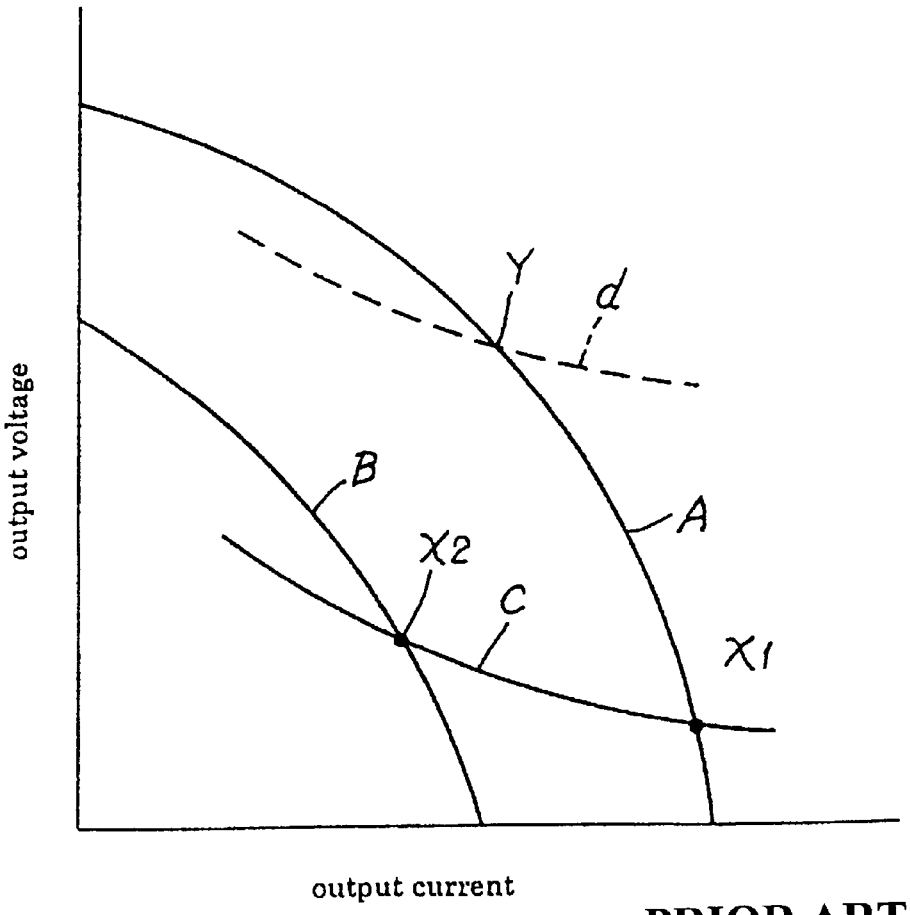
PRIOR ART Fig. 27
FIG. 27 is a graph representing load characteristics of a load circuit of said conventional discharge lamp lighting device.

Next, the discharge lamp lighting device 1 according to the 12th embodiment of the invention is explained, referring to FIG. 25.

The discharge lamp lighting device 1 according to the twelfth embodiment has the same configuration as that of the discharge lamp lighting device 1 according to the 10th embodiment except that the inductor is comprised of a filament heating transformer Tr2 having a primary winding TR2*a* connected in series with the capacitor C6, the filament heating transformer Tr2 also having filament heating windings in a number corresponding to the number of the filaments (for example, filament heating windings TR2*b*, tr2*c*,Tr2*d*,Tr2*e* corresponding to the filaments FL1*a*,FL1*b*, FL2*a*,FL2*b*) and that said filament heating windings Tr2*b*, tr2*c*,Tr2*d*,Tr2*e* are respectively connected to the filaments FL1*a*,FL*b*,FL2*a*,FL2*b*.

Although the basic function of this embodiment is the same as that of the discharge lamp lighting device 1 according to the 10th embodiment, a feature of the present embodiment lies in that it permits the luminaire to be designed as a rapid-start type by heating the filaments FL1*a*,FL1*b*,FL2*a*, FL2*b* of the fluorescent lamps FL1,FL2 by means of the filament heating transformer Tr2 and that it enables the lagging exciting current which pass the primary winding TR2*a* of the filament heating transformer Tr2 to flow to the field-effect transistors Q2,Q3.

The discharge lamps used in any one of the embodiments described above are not limited to a particular type or a size; they may have a normal thickness or may be of a small diameter tube type. 'A discharge lamp of a small diameter tube type' mentioned above may be, for example, a compact-type fluorescent lamp, a compact self-ballasted fluorescent lamp, a circular fluorescent lamp adapted exclusively for high-frequency lighting, such as an FHC20, an FHC27 and an FHC34. The tube used in any one of these examples of small diameter tube lamps have an outer diameter of 16.5 mm.

There are no particular limitations in the configuration of a load circuit, as long as it includes a discharge lamp, an inductor and a capacitor. However, a load circuit has to have an intrinsic resonance frequency and include a current limiting element for limiting the current from the high frequency generating means in order to light a discharge lamp in stable conditions. A load circuit may also include a start-up circuit for starting a discharge lamp. Generally, an inductor is principally used as a current limiting element for a discharge lamp, and it may be included in the load circuit in the form of an inductor connected separately from the high frequency generating means or a leakage inductance from an output transformer or a similar element that forms a part of the high frequency generating means.

Generally, the capacitor is used for preheating a discharge lamp. In case other capacitors are also used, they may be connected in series with the current limiting element so as to serve as a part of the current limiting element or for interrupting a direct current.

Furthermore, one or more load circuits may be provided. In cases where a plurality of load circuits are used, they may be connected in parallel with the high frequency generating means. A plurality of discharge lamps may be connected in series to a single load circuit.

On condition that it is capable of outputting a high-frequency voltage to the load circuit(s), the high frequency generating means may have any desired configuration; it may use any circuit system for generating a high frequency, including an inverter of such a type as a blocking oscillation, a multivibrator, a half-bridge, a full-bridge, or of a modified form of any one of these types. Although there is no limitation as to whether the high frequency generating means is of a voltage resonance type or a current resonance type, a high frequency generating means of a current resonance type has a such a benefit as to permit the use of a switching means which has less ability to withstand pressure and also be capable of expanding the variable frequency range, because it enables the setting of frequency regardless of the inductance or the capacitance of the load circuit or the load circuits.

Furthermore, in order to dim the discharge lamp(s), the output from the high frequency generating means may be reduced by means of changing the duration of the on-duty thereof.

A DC power supply which may typically be obtained by rectifying the current from a commercial AC power supply and smoothing the rectified current may be used as the power source for the high frequency generating means. Although a smoothing capacitor may be used for smoothing the current, a smoothing capacitor has such a drawback that it reduces the power factor. For this reason, it is permissible to use a DC/DC converter, such as a boosting chopper, which is capable of providing a source voltage at a desired voltage level and will not produce high harmonic distortion.

The control means according to the invention is capable of setting the illumination mode of the discharge lamp(s) in at least two modes, i.e. the full-intensity illumination mode and the dimming mode by way of controlling the DC/DC converter that constitutes the high frequency generating means or the DC power supply. The dimming may be conducted in the manner of either step dimming or continuous dimming. If it is necessary, the control means may include other modes, such as a light-off mode, to which the control means may be changed over. Furthermore, a wall switch, a remote controller that may use infrared rays or the like may be used as means to operate the control means.

The aforementioned load characteristic imposing means serves to set appropriate constants for the inductor and the capacitor, which form a part of the load circuit(s), and determine an appropriate circuit configuration for the load circuit(s). In addition, the load characteristic imposing means may serve to set an appropriate frequency to be output by the high frequency generating means in accordance with the operating condition of the discharge lamp(s). Doing so enables the change of load characteristics upon switching between the full-intensity illumination mode and the dimming mode. In case of some embodiments, it is possible to change load characteristics upon changeover of the operation mode between the electrode heating and the starting up, or changeover of the operation mode among the electrode heating, the starting up and the full-intensity illumination. In case of yet other embodiments, it is possible to change load characteristics when the operation mode is changed over to any one of the modes selected from among the electrode heating, the starting up, the full-intensity illumination and dimming.

The control mentioned above may easily and automatically be conducted by programming a control procedure into an IC or the like or conducted manually, if it is necessary. When the control is conducted, the frequency output from the high frequency generating means may be changed together; the frequency may be reduced during preheating, increased at the time of starting up, or reduced during full-intensity illumination, wherein it does not matter whether the frequency for preheating and the frequency for full-intensity illumination are identical or different.

The short-circuit current can be made effective by changing the frequency of the high frequency generating means. To be more specific, by lowering the frequency, the impedance of the load circuit is reduced so that the short-circuit current is increased. On the contrary, by increasing the frequency, the impedance of the load circuit is increased so that the short-circuit current is reduced.

The capacitance may be changed when, for example, the discharge lamp reaches the last stage of its life, in order to change load characteristics so that the discharge lamp can be extinguished even more reliably. This may be done by reducing the capacitance to reduce the release voltage at the end of the life of the discharge lamp. The capacitance may also be changed depending on whether the lamp is on in the full-intensity illumination mode or the dimming mode; the capacitance may be increased during dimming so as to increase the release voltage. Furthermore, when the discharge lamp is started, a relatively large capacitance may be provided, thereby increasing the amount of the electrode heating current to conduct electrode heating as desired.

The detecting means may have any configuration on condition that it is capable of detecting a discharge lamp coming to the end of its life based on the voltage between the electrodes of a discharge lamp, lamp current, power consumption of the discharge lamp, the light or the like.

Furthermore, the invention is applicable to a lighting fixture of any desired type; it does not matter whether it is for a household, a public or private facility, indoors or outdoors. Any device that uses the light from a discharge lamp is applicable.

The high frequency generating means has to be capable of changing the frequency of its high frequency output between at least two stages: a frequency sufficiently lower than the intrinsic resonance frequency of each load circuit, and a frequency higher than said intrinsic resonance frequency. The change of the frequency may be conducted continuously.

The lamp voltage of a discharge lamp at the end of its life is extremely higher than that of a lamp in normal conditions. In case of the present invention, however, the release voltage has to be noticeably lower than the lamp voltage at the end of the life of the lamp; it is recommended to be set at approximately 2 to 2.7 times as high as the lamp voltage of a lamp that is in normal conditions.

The load characteristics have to be such that the release voltage is low while the amount of the short-circuit current is relatively large. Such load characteristics can be obtained easily by appropriately setting the inductance and the capacitance of the load circuit(s) as well as the frequency of the high frequency generating means. For example, in cases where the capacitor is connected in parallel with a discharge lamp, appropriate load characteristics can easily be obtained by setting the capacity of said capacitor at a small value so that no actual resonance will be generated during full-intensity illumination. The term 'a frequency sufficiently lower than the intrinsic resonance frequency' mentioned above means such a frequency as to not produce an actual resonance and cause an output of release voltage that is approximately 2 to 2.7 times higher than the lamp voltage of a normal discharge lamp.

Furthermore, the inductor is not limited to serve for a single function; other than providing an inductance, it may have other functions or serve for other purposes. For example, it may be the primary winding of a filament heating transformer, or a transformer adapted to increase or reduce the voltage so as to adjust the release voltage on the load circuit during full-intensity illumination. It is also permissible to connect a capacitor in series to the inductor in order to interrupt the direct current in its course to the inductor, thereby avoiding undesirable magnetic saturation.

What is claimed is:

1. A discharge lamp lighting device including:

a load circuit which is provided with a discharge lamp, an inductor and a capacitor, said discharge lamp having electrodes;

a high frequency generating means for supplying said load circuit with a high frequency output;

a control means for setting said discharge lamp in a full-intensity illumination mode or a dimming mode;

a load characteristic imposing means for giving the load circuit first load characteristics that have a relatively low release voltage and a large amount of short-circuit current during full-intensity illumination or full-intensity illumination in addition to preheating of the electrodes; and said load characteristic imposing means further for giving, during dimming or at the time of starting up, said load circuit second load characteristics that have a relatively high release voltage compared to the release voltage of said first load characteristics and a small amount of short-circuit current compared with the short-circuit current of said first load characteristics so that the load characteristic curves of said first load characteristics and said second load characteristics intersect the operating curve of said discharge lamp during normal operation of said discharge lamp but do not intersect the operating curve of at the end of the life of said discharge lamp.

2. A discharge lamp lighting device as claimed in claim 1, wherein:

the inductor of each load circuit is connected in series with the discharge lamp;

the capacitor of each load circuit is connected in parallel with the discharge lamp; and each load circuit is provided with a capacity changing means for changing the capacity of the capacitor.

3. A discharge lamp lighting device as claimed in claim 2, wherein a detecting means for detecting termination of the life of each discharge lamp is included so that the capacitance of the capacitor is reduced by the capacity changing means when the termination of the life of the corresponding discharge lamp is detected.

4. A discharge lamp lighting device as claimed in claim 1, wherein the discharge lamp lighting device includes a frequency changing means for changing the frequency output from the high frequency generating means when a detecting means detects termination of the life of a discharge lamp during dimming of said discharge lamp.

5. A discharge lamp lighting device as claimed in claim 1, further including an inductor connected in parallel with said load circuit.

6. A discharge lamp lighting device as claimed in claim 1, wherein a resonance voltage resulting from a higher operating frequency is applied to a charge lamp at the initiation of lighting of said discharge lamp.

7. A discharge lamp lighting device as claimed in claim 1 further comprising:

a luminaire, said luminaire, including a main body to which said discharge lamp is mounted; and said luminaire including said discharge lamp lighting device for lighting said discharge lamp.

8. A discharge lamp lighting device including:

a plurality of load circuits connected in parallel with one another, each load circuit connecting to a discharge lamp having electrodes, an inductor and a capacitor;

a high frequency generating means which is shared by said load circuits and adapted to supply them with a high frequency output;

a load characteristic imposing means for giving the load circuit first load characteristics that have a relatively low release voltage and a large amount of short-circuit current during full-intensity illumination or full-intensity illumination in addition to preheating of the electrodes; and said load characteristic imposing means further for giving, during dimming or at the time of starting up, said load circuit second load characteristics that have a relatively high release voltage compared to the release voltage of said first load characteristics and a small amount of short-circuit current compared with the short-circuit current of said first load characteristics so that the load characteristic curves of said first load characteristics and said second load characteristics intersect the operating curve of said discharge lamp during normal operation of said discharge lamp but do not intersect the operating curve of at the end of the life of said discharge lamp.

9. A discharge lamp lighting device as claimed in claim 8, wherein the discharge lamps of said plurality of load circuits have different rated power consumption.

10. A discharge lamp lighting device as claimed in claim 8, wherein the discharge lamp lighting device includes a control means which may be changed over between the full-intensity illumination mode and the dimming mode and is adapted to switch the output level of the high frequency generating means to the level for the full-intensity illumination mode when any one of the discharge lamps reaches the end of its life during dimming.

11. A discharge lamp lighting device as claimed in claim 8, wherein:

the inductor of each load circuit is connected in series with the discharge lamp;

the capacitor of each load circuit is connected in parallel with the discharge lamp; and each load circuit is provided with a capacity changing means for changing the capacity of the capacitor.

12. A discharge lamp lighting device as claimed in claim 8, wherein the discharge lamp lighting device includes a frequency changing means for changing the frequency output from the high frequency generating means when a detecting means detects termination of the life of a discharge lamp during dimming of said discharge lamp.

13. A discharge lamp lighting device as claimed in claim 8, further including an inductor connected in parallel with said load circuit.

14. A discharge lamp lighting device as claimed in claim 8, wherein a resonance voltage resulting from a higher operating frequency is applied to a discharge lamp at the initiation of lighting of said discharge lamp.

15. A discharge lamp lighting device including:

a load circuit which is provided a discharge lamp having electrodes, an inductor, and a capacitor;

a control means for setting full-intensity and dimming;

a load characteristic imposing means for generating high frequency output having a frequency sufficiently lower than the intrinsic resonance frequency of said load circuit during one of full-intensity illumination and full-intensity illumination in addition to preheating of the electrodes, thereby giving the load circuit first load characteristics that have a relatively low release voltage and a large amount of short-circuit current; and said load characteristic imposing means further adapted to give, during dimming or at the time of starting up, thereby giving said load circuit second load characteristics that have a relatively high release voltage compared to the release voltage of said first load characteristics and a small amount of short-circuit current compared with the short-circuit current of said first load characteristics so that the load characteristic curves of said first load characteristics and said second load characteristics intersect the operating curve of said discharge lamp during normal operation of said discharge lamp but do not intersect the operating curve of at the end of the life of said discharge lamp.

16. A discharge lamp lighting device as claimed in claim 15, wherein:

the inductor of the load circuit is connected in series with the discharge lamp; the capacitor has a small capacity and is connected in parallel with the discharge lamp; and the intrinsic resonance frequency of the load circuit is set sufficiently higher than the frequency at which the high frequency generating means operates in the full-intensity illumination mode.

17. A discharge lamp lighting device as claimed in claim 15, wherein the operating frequency of the high frequency generating means is set such that:

$f0/3 \leqq f \leqq f0/2$ in which inequality the operating frequency of the high frequency generating means during full-intensity illumination is represented by f, and the intrinsic resonance frequency of the load circuit is represented by f0.

18. A discharge lamp lighting device as claimed in claim 15, wherein a plurality of load circuits are connected in parallel with one another to the output end of the high frequency generating means and are arranged such that a discharge lamp or discharge lamps that have reached the end of life are either darkened or extinguished, while the discharge lamps in normal conditions remain lit.

* * * * *